US007179182B2

(12) United States Patent
Summers

(10) Patent No.: US 7,179,182 B2
(45) Date of Patent: Feb. 20, 2007

(54) T-LOCK BROADHEAD AND TIGHT POINT MATCHED BALANCE POINT ARCHERY POINT SYSTEM

(76) Inventor: John C. Summers, 2504 Navarra Dr. #203, Carlsbad, CA (US) 92009

( * ) Notice: Subject to any disclaimer, the term of this patent is extended or adjusted under 35 U.S.C. 154(b) by 0 days.

(21) Appl. No.: 10/969,576

(22) Filed: Oct. 20, 2004

(65) Prior Publication Data

US 2005/0124443 A1 Jun. 9, 2005

Related U.S. Application Data

(60) Provisional application No. 60/513,366, filed on Oct. 21, 2003.

(51) Int. Cl.
*F42B 6/08* (2006.01)

(52) U.S. Cl. ..... 473/583; 473/584

(58) Field of Classification Search ..... 473/583, 473/584

See application file for complete search history.

(56) References Cited

U.S. PATENT DOCUMENTS 4,146,226 A 3/1979 Sorensen
4,381,866 A * 5/1983 Simo ..... 473/584
4,505,482 A 3/1985 Martin, Sr.
4,529,208 A 7/1985 Simo
5,044,640 A * 9/1991 DelMonte et al. ..... 473/584
5,114,156 A 5/1992 Saunders
5,160,148 A 11/1992 Musacchia, Sr.
5,871,410 A * 2/1999 Simo et al. ..... 473/583
6,027,421 A 2/2000 Adams, Jr.
6,077,180 A * 6/2000 Adams, Jr. ..... 473/584
6,290,903 B1 9/2001 Grace, Jr. et al.
6,595,881 B1 7/2003 Grace, Jr. et al.
6,749,801 B1 6/2004 Grace, Jr. et al.
6,866,600 B1 * 3/2005 Johnson ..... 473/583

* cited by examiner

*Primary Examiner*—John A. Ricci
(74) *Attorney, Agent, or Firm*—Stetina Brunda Garred & Brucker

(57) ABSTRACT

Provided is a broadhead for an arrow having a shaft with a shaft bore. The broadhead comprises a ferrule and a plurality of blade members. The ferrule has a mating end and a tip end with a plurality of convex ridges being equiangularly spaced around the ferrule such that the ferrule has a tri-oval cross section. Each one of the ridges has a blade groove formed therein for receiving one of the blade members. The blade members each have a base portion that is shaped complementary to the blade groove so that the blade member may be axially insertable into the blade groove. The broadhead includes a shank extending outwardly from the mating end and which is threadably engagable into the shaft bore. An O-ring mounted on the shank is captured between the shank and the shaft bore when the broadhead is secured to the arrow at the mating end.

27 Claims, 8 Drawing Sheets

T-LOCK BROADHEAD AND TIGHT POINT MATCHED BALANCE POINT ARCHERY POINT SYSTEM

CROSS-REFERENCE TO RELATED APPLICATIONS

This application claims the benefit of U.S. Provisional Application No. 60/513,366, filed Oct. 21, 2003.

STATEMENT RE: FEDERALLY SPONSORED RESEARCH/DEVELOPMENT (Not Applicable)

BACKGROUND OF THE INVENTION

The present invention relates generally to arrowheads for archery arrows and, more particularly, to a uniquely configured broadhead having a relatively long monolithic solid ferrule and a high strength, rear entry blade mounting system with the blades having a complex cutting edge geometry for effective harvesting of game. The ferrule and the blades are manufactured using metal injection molding ("MIM") and/or liquid metal molding ("LMM"). The present invention further relates to defining and applying a superior MIM process. In addition, the present invention relates to a field point having a mass and center of gravity that is substantially equivalent to the broadhead for accurate tuning of an archery bow from which the broadhead may be shot.

Archery broadheads with fixed or replaceable blades are well known in the art. Such broadheads are deployed on the end of an arrow and may be adapted to be removable from the arrow. The broadhead itself typically comprises a body or ferrule into which blade members may be inserted such that the blade members may be replaced or sharpened. Generally two types of replacement blade broadheads exist; broadheads with front loading blade systems and broadheads with rear loading blade systems. The front entry blade systems are characterized by broadheads that secure the blade with a screw-on or screw-in tip which is threadedly attached to the broadhead ferrule. The blades are inserted from the tip end which is the end farthest from the arrow.

The rear entry broadhead is characterized by the blades entering the ferrule blade grooves from the threaded shank end of the broadhead ferrule which is the end closest to the arrow. The rear entry replacement blade broadhead secures the blades by a washer which is compressed to the arrow using the torque provided by the arrow or by a threaded-on nut which connects to the broadhead ferrule on the threaded shank. Typically rear entry replacement blade broadhead ferrules are more robust compared to front loading broadhead ferrules. In addition, only rear entry replacement blade broadheads can offer a monolithic solid ferrule.

When offered in any of the high strength materials like stainless steel or titanium, the rear entry monolithic ferrule yields the best overall strength and robustness characteristics. Unfortunately, many broadheads of the prior art suffer from several deficiencies that detract from their overall utility. For example, in many prior art broadheads, the connection of the blade members to the ferrule is relatively weak causing the ferrule or blade member to become damaged upon impact with relatively hard bones of large game. In addition, the ferrule may become damaged upon impact with other hard surfaces such as rocks that are hit during missed shots.

U.S. Pat. No. 5,160,148 issued to Musacchia discloses a broadhead having a front loading ferrule with axial passageways and slots extending through the length of the ferrule. Blades are secured to the ferrule by sliding the blades from the front or tip end into the slots. A tip member is threaded onto a leading edge of the ferrule to capture the blades within the slots. Although the broadhead as disclosed in the Musacchia reference provides a relatively simple means for blade removal, the axial passageways and slots in the ferrule may greatly weaken the ferrule such that impact with relatively hard surfaces such as bone or rocks may cause the ferrule to bend or shatter and may also result in shearing off, shattering, or splitting of the threaded-on tip.

U.S. Pat. No. 6,595,881 issued to Grace describe a powder injection molded fixed blade broadhead where the broadhead blades are secured by a threadedly secured tip. No claims are made regarding this fixed blade broadhead but several conclusions can be taken from the drawings of Grace. Broadheads with threadedly attached tips are prone to misalignment which can cause arrows to veer off course. The ferrule has a triangular cross section and the blades are secured into T-shaped blade slots and inserted from the threaded tip end. The T-shaped slots are shown to have constant width and the T-shaped base is also of constant width. Because Grace is understood to disclose that the as-molded T-shaped blade slots lack draft, it is believed that the ferrule cannot be effectively molded.

At best, the ferrule will experience distortion and the mold itself will experience premature wear on the T-shaped mold inserts. Furthermore, the base of the T-shaped blade slot base has sharp right angled inside corners which generate stress risers in the molded part and can lead to molded part distortions and failure. The ferrule taper is shown as linear with the widest outside diameter towards the rear or mating end. A tapered or linear tapered ferrule starting from the mating end to the screw in tip as shown by Grace is heavier than a ferrule which has a non-linear tapered ferrule or which has a surface which has multiple stepped tapers. The ideal ferrule cross-section would be nearly constant over much of the ferrule length which would allow for sufficient length and strength around the blade grooves. In addition, the tapered triangular ferrule of Grace must be shortened in order to meet the specified weight which is an undesirable feature.

U.S. Pat. No. 5,160,148 issued to Musacchia clearly shows a relatively long non-linear tapered ferrule. The Musacchia ferrule is disclosed as having two different tapers or stepped tapers. U.S. Pat. No. 4,529,208 issued to Simo shows a varying shaped cross-section which extends the length of the ferrule. The Grace ferrule with the same maximum diameter base section, which mates with the arrow, will be heavier when compared to the Musacchia and Simo ferrules of equal length and maximum base diameter. For this reason, the Grace ferrule must be shortened in order to meet a given design weight such as 125 grains. Reducing the overall ferrule length is undesirable as it causes the blade to have a steep angle which increases blade stress and can reduce penetration.

In addition, the cutting diameter of the broadhead may need to be reduced because of the shortened ferrule length which can reduce wound channels which, in turn, reduces the effectiveness of harvesting game humanely. The threadedly secured tip is relatively weak when compared to a tip of equal or less diameter that is machined or molded on a monolithic solid ferrule. The triangular cross section of the Grace ferrule causes undesirable thin wall molding conditions, especially considering that the outside surface is slightly concave as shown between the inner T-slots and the outside surface of the ferrule which can result in a weak ferrule. Since the triangular ferrule tapers with the smallest portion towards the tip, the wall thickness between the T-shaped slot and the outer surface is thinnest at the tip end. The T-shaped slots of Grace are disclosed as being molded but no taper or draft is shown or discussed.

Because the threadedly secured tip is shown to thread into the broadhead ferrule, sufficient wall thickness must occur between the tip's threaded post and the T-shaped slots. The combination of providing sufficient wall thickness between the wide T-shaped slot and the outer concave triangular ferrule surface, and providing adequate thickness between the threaded tip aperture and the T-shaped slot with the widest section of the T-shaped slot at the tip, and combining with a tip post diameter of sufficient strength to withstand high impact, all result in a ferrule tip which is large in diameter when compared to the tip diameter of a rear entry monolithic ferrule.

A large diameter tip is heavier than a smaller diameter tip and as such the broadhead must be shortened to achieve the typical specified weight. This reduced length causes the broadhead blade to be shorter which results in a steep blade angle and possibly a smaller cutting diameter such that the effectiveness of generating wound channels may be compromised. In addition the T-shaped slots with their widest section towards the tip, limits the overall length of a broadhead. Any attempt to seat the blades deeper towards the longitudinal axis, which could allow for a longer ferrule, is negated due to the threaded-in tip and its requirement to be of large enough diameter to be substantially strong. If the tip is broken the blades are no longer secured and are free to be displaced or fall out of the ferrule. The broadhead can no longer take game humanely.

In Grace, the blades are shown to be triangularly shaped which can cause unpredictable flight and wind planing which results in the broadhead veering off target. Grace shows a T-shaped blade base which does not taper in width which is otherwise desirable in a molded part. Furthermore, the T-shaped blade base is shown to have sharp right angles on all corners which provide stress risers in molded parts and increase the possibility of molding, debinding, and sintering distortions.

Grace discloses a preferred embodiment wherein the blades are releasably secured to ferrule near the tip. However, one skilled in the art will recognize that the ferrule could be configured such that a releasing element disposed over shank or arrow shaft functions to releasably secure the blades to the ferrule. A solution to the above-described deficiencies of the Grace tip is not obvious. A completely different arrow securing design or rear entry broadhead is even less obvious. A need exits for a robust replacement blade broadhead of sufficient length and cross section so as to offer a superior blade retention system.

U.S. Pat. No. 4,146,226 issued to Sorensen discloses an arrowhead having a plurality of longitudinal slots formed about a body of the arrowhead with a dovetail angle formed at an intermediate location in the body along each one of the slots. A removable blade may be secured to the body by means of an extension that is inserted into a receiving recess in the body. A conical nose member is installed on a front end of the body. Although the arrowhead of the Sorensen reference allows for blade removal for replacement or sharpening thereof, the dovetail slot weakens the ferrule such that the ferrule may shatter upon impact with a hard surface and the separate removable tip is prone to misalignment with the ferrule.

Another deficiency associated with broadheads of the prior art is ineffective blade design. Ideally, blade members of a broadhead are designed such that the broadhead will easily penetrate the hide of an animal and generate extensive internal wound channels in order to cause the animal to swiftly and humanely expire. In addition, the blade members of a broadhead are ideally configured so as to enhance the accuracy of the flight pattern of the arrow.

Unfortunately, in prior art broadheads, the use of large blade members for generating extensive wound channels has an adverse effect on flight characteristics due to wind planing (veering off course) of the arrow due to the large blade size. Conversely, the use of small blades, while increasing the flight accuracy, results in ineffectiveness of the blade in generating wound channels. The prior art includes several broadhead configurations that attempt to reconcile these opposing characteristics.

For example, U.S. Pat. No. 4,505,482 issued to Martin discloses a broadhead having a ferrule with symmetrically mounted blades. An outer edge of each one of the blades slopes toward the other blades at a shallow angle to form a needle-like point. At a rear portion of each one of the blades is a vent opening which purportedly reduces noise generated by the arrow during flight. Such noise is undesirable in bow hunting as the noise may startle the game when the arrow is shot. Unfortunately, such vent openings of the Martin reference are understood to increase noise and impede penetration of the arrow into the animal such that the effectiveness in reducing noise and generating wound channels may be compromised.

U.S. Pat. No. 5,044,640 issued to DelMonte et al. discloses a broadhead having a plurality of blades spaced about a conical tip shaft. Each one of the blades is shown and illustrated with a generally large radius. The broadhead includes a ring blade having a diameter larger than that of the arrow upon which the broadhead is mounted such that when the arrow is shot from a bow, the ring blade will cut a hole that is greater than the shaft diameter. In this manner, the arrow shaft cannot plug the entrance wound made by the broadhead such that the animal may more quickly expire from blood loss. Although the broadhead of the DelMonte reference may facilitate blood loss, the generally small radius of the blades is understood to minimize the ability to generate extensive wound channels and the ring blade reduces penetration.

Another deficiency associated with removable broadheads of the prior art is relative movement between the broadhead and the arrow shaft. As was earlier mentioned, accuracy in the flight of the arrow is critical in bow hunting for obvious reasons. However, prior art broadheads that are removably mounted on an arrow may become loosened while the arrow is resting in the bow quiver resulting in relative movement between the broadhead and the arrow. In addition to causing a rattling noise while stalking game which may scare the game away, such relative looseness may also result in misalignment between the broadhead and the arrow which may cause the arrow to porpoise, fishtail or otherwise veer from its flight pattern. Furthermore, such relative looseness may allow moisture to enter the gap between the broadhead and the arrow resulting in corrosion of metallic mating surfaces of the broadhead and arrow shaft. Over time, the looseness may eventually result in loss of the broadhead while being carried in the bow quiver.

U.S. Pat. No. 6,595,881 issued to Grace tries to address the problem of broadheads loosening on the arrow shaft by deploying a compliant member interposed between said ferrule and said arrow shaft. This technique compresses the compliant member between the ferrule and the shaft. Over time this technique actually can create a loose broadhead. Compliant materials such as Teflon, rubber, and silicon are materials which will permanently deform, cold-flow, and extrude while under intense pressure as is the case when you tighten the broadhead ferrule to the face of the arrow insert. Once the compliant member deforms the broadhead will loosen. Furthermore when the compliant member is deployed between the base of the broadhead ferrule and the face of the arrow insert, it can cause misalignment between the broadhead and the arrow shaft. A need exits for a device to prevent a broadhead or field point from prematurely loosening from the arrow shaft and to center the broadhead or field point within the arrow shaft.

Another deficiency of broadheads of the prior art concerns the tuning of the bow from which the arrow is to be shot. As was earlier mentioned above, accuracy of the flight pattern of the arrow is critical in bow hunting for obvious reasons. Archers typically tune their bows using field points instead of the broadhead so that the sharpened edges of the broadhead do not become nicked or damaged. Field points generally lack the blades used in broadheads as the field point is only used to target practice, to tune the bow, and to check and align the point of aim of the bow. However, in order to accurately tune the bow such that the broadhead will fly similarly to the field point, the field point must have the same length, mass and balance point as the broadhead and must be durable to withstand repeated use on targets which may have broken arrows and points imbedded in the practice target.

For example, if the broadhead has a mass of 125 grains and a given center of gravity, the field point should likewise have a mass of 125 grains and a center of gravity in the same location as that of the broadhead and be of the same length as the broadhead. Unfortunately, unless a field point is specifically manufactured to match the mass and balance point of a given broadhead, it is difficult to accurately tune the bow. In addition, because field points lack blades which may be used to tightly thread the field point into the arrow, the field point may not be tightly secured to the arrow such that, over time, relative looseness may develop between the field point and the arrow which can reduce bow tuning accuracy as well as lead to a loss of the field point. Glue, wax, epoxy and the like is sometimes used by archers to rigidly secure the field point to the arrow. However, such techniques are messy and time consuming.

U.S. Pat. No. 6,027,421 issued to Adams discloses a tuning point for archery. This tuning point is defined as having a separate tip, body and weight ring. This tuning point is further defined by the tip and weight ring as being steel and the body is aluminum. Tuning tips of this design are prone to loosening from the arrow insert causing noise and causing an overall distraction while practicing archery. Tuning points of this design are weaker when compared to monolithic solid tuning points. The separate tip is prone to misalignment with the arrow shaft and may shear off when impacting with a hard object. The relatively long aluminum body may lack straightness. New families of compact, short broadheads exist, and these heads have balance points which are closer to the arrow. Since these heads are shorter they require a balance point closer to the arrow and have the overall length shorter. A need exits for a monolithic solid tuning point which has a balance point which closely matches relatively short broadheads and a need exits for a tuning point that will not prematurely loosen from the arrow shaft.

U.S. Pat. No. 5,114,156 issued to Saunders discloses an arrow point which threadedly attaches to an arrow insert within the practice arrow. This arrow point is prone to vibrate loose and cause noise and unwanted distraction while practicing archery. Archers apply several techniques to prevent arrow points of this design from vibrating loose. These include applying glue, epoxy, and wax to the threaded end of the arrow point which prevent the arrow point from loosening. These applications to the threaded connection may foul the insert and may require the arrow inserts replacement if the arrow point is to be exchanged for a different arrow point. There is a need for a practice field point that does not vibrate loose or prematurely loosen from the arrow shaft.

Regarding deficiencies of the prior art associated with manufacturing of broadheads, U.S. Pat. No. 6,290,903 issued to Grace discusses the method of manufacture of broadheads using a powder injection molding ("PIM") process. Grace describes the PIM process as: 1. Premixing metal powder with binder in a first blending step; 2. Fully mixing powdered metal and binder into a nearly homogeneous mixture; 3. The homogenous mixture is pelletized in a second blending step; 4. The powdered metal composition is injected into a broadhead mold; 5. The molded greenware broadhead is processed to remove the binder, by the preferred process of immersing the broadhead in a solvent; 6. In a second debinding process, the partially debound broadhead is placed in a thermal debinding furnace where any remaining binder is burned off and if required this furnace can perform a pre-sintering step; 7. The powdered metal broadhead is placed in a sintering furnace and sintered at an elevated temperature and at an elevated pressure to increase density. Once sintering is complete the broadhead is in its final shape and includes its molded features.

Grace discloses that though solvent debinding is preferred, one skilled in the art will readily recognize that any process or combination of processes could be employed to debind the greenware broadhead. However, it is believed that debinding processes are uniquely suited to a specific PIM process. More specifically, it is believed that the PIM process as a whole is a dependent process where each of the processing steps is dependent on the other processing steps. A change in the debinding process requires a change in the binder or raw material which dictates the injection molding parameters, and changes the sintering process up to and including requiring a completely different type of sintering furnace.

Grace begins with premixing metal power and binder but skips several steps in the process. In the PIM process both the metal powder and binder must be procured separately. The binder and the metal powder must be certified as to meeting specified criteria. After mixing and before pelletizing, the mixture must be checked to make sure it is indeed homogeneous. Uneven distribution of the powder in the binder will result in the loss of dimensional control and cause variations in part density. Variations in the feedstock consistency from batch to batch will also result in a loss of part dimensional control. Following pelletizing, the pellets must be checked for proper performance and suitability for molding.

Consistent granule feedstock is a requirement to obtain consistent molded parts. The injection mold must be scaled up in size to match the binder system used. Various binder systems require the mold to be scaled up from 17% to 21% and this is determined by the binder and base metal material. If the chosen binder is intended for solvent debinding, it will have a different scale-up percentage when compared to a binder designed for catalytic debinding. If a part is molded in a mold designed for a 21% part scale-up with a feedstock which actually requires a 17% scale-up, then the molded part will weigh more and be oversized. Because broadheads are measured in grains where 7000 grains is equivalent to an English pound, a 125 grain broadhead requires precise dimensional control because precise part weight (i.e., precise broadhead mass) is required. A broadhead weighing more than five (5) grains over or under weight when molded with different binder systems is Unacceptable.

Once the injection mold is in place in the injection molding machine, the part may be molded and is then ready for debinding. Suitable binders for solvent debinding can often exhibit weak greenware strength and care must be taken to prevent damage to the part prior to and during solvent debinding. The solvent debinding process is very slow and it is the gating item in the PIM process. Furthermore, the solvent debinding process eliminates the likelihood of having a continuous process. Solvent debinding is processed at relatively high temperatures and part distortion is possible and temperature control and uniformity are critical.

Injection molding is believed to outpace solvent debinding on large part runs which necessitates that parts must be stored in a holding process prior to debinding. This unfinished inventory has a negative affect with turning the unfinished inventory into revenue. Once solvent debinding is complete the parts are then transferred to thermal debinding. Finally the parts are sintered at high temperature and at high pressure. The requirement to have two debinding steps is slow and requires added capital expense. The requirement to sinter parts at high pressure means that an oven must be opened, parts to be sintered must be loaded and, of course, the furnace must be closed, all of which can increase the risk of part damage, contamination and furnace seal failure.

Thus, there is a need for a standard ambient pressure or slightly negative pressure sintering furnace which is ideal for continuous production. High pressure ovens as described by Grace are prone to leak and difficult or impossible to run a belt conveyor through which is typical of continuous processes. It is believed that the Grace process lacks the ability to readily automate the manufacturing of broadheads and make it continuous and is largely batch oriented starting from the requirement to procure and mix, and compound two different materials. Finally the chemicals used in chemical debinding can be caustic, damaging to the ozone layer, and expensive to dispose of and they include substances like chlorine and heptane.

An alternative debinding system is neither obvious nor interchangeable as Grace discloses. The PIM process as disclosed in Grace is not understood to be capable of filling the need for a system which can be run in a continuous fashion wherein the process requires no mixing of components and thus allows for streamlining of the quality and procurement process. Removing component mixing as a process step creates the desired need to purchase ready made, certified, granulized molding feedstocks that can be fed directly into the injection molding machine without verifying component makeup or homogeneity of granule feedstock received from the supplier and furthermore increases the overall quality of the process by removing batch to batch component mixing variances.

A need therefore exists to reduce the capital cost of PIM systems by eliminating the need to purchase mixing and pelletizing equipment and return the focus of a molding facility back on its core business, injection molding. There is also a need to eliminate potentially caustic and dangerous solvent debinding systems and remove any requirement to process, remove or dispose of any debinding bi-products. In addition, a need exits to debind at a rate of 10 to 40 times faster than solvent debinding in order to enable continuous production. There is a need to eliminate at least one debinding process such as thermal debinding. There is a need for a part, as a result of molding with a pre-made granular feedstock, which exhibits tremendous greenware strength for easy handling and ease of debinding.

A need therefore exists for a metal injection molding ("MIM") system that, as a result of the above requirements, delivers very cost effective parts with the ability to lower part costs due to continuous production. The Grace process is understood to disclose a minimum of seven (7) process steps. There is a need for a MIM process with only three (3) process steps. The Grace process requires mixing/blending and pelletizing equipment. The Grace process requires two furnaces, a debinding furnace and a high pressure sintering furnace. These repeated process steps need to be eliminated.

There is a need to reduce the capital equipment costs, reduce the process steps and increase production as defined by the Grace powder injection molding process. The solutions to these market and process needs associated with PIM are not obvious. There is a need for a MIM process which uses commercially available feedstock. This MIM process must have the capability to run as a batch process and also a high volume continuous process and must eliminate mixing and pelletizing of components. There is a need for a MIM process which creates no harmful bi-products or any bi-product requiring waste removal. There is a need for an MIM process that greatly reduces the number of process steps as required by the prior art PIM process.

In light of the above discussion, there exists a need in the art for a broadhead having blade members-that are joined to the ferrule in a relatively strong manner such that the ferrule or blade member will not be damaged during use. In addition, there exists a need in the art for a broadhead having a blade design that allows for stable and accurate flight of the arrow without wind planing. There also exists a need in the art for a broadhead having a blade design that will easily penetrate the hide of an animal and generate extensive internal wound channels.

Furthermore, there exists a need in the art for a broadhead that may be removably secured on an arrow with minimal relative movement therebetween so as to improve the accuracy of the flight of the arrow and to prevent loss of the broadhead. There also exists a need in the art for a broadhead that is easy and safe to assemble and disassemble. Finally, there exists a need in the art for a field point having physical properties (i.e. mass and balance point and length) that match a given broadhead to allow for accurate bow tuning. A need exists for a field point which offers a high strength construction. There exists a need in the art for a field point which remains tight to the arrow shaft and remains quiet in flight. There exists a need in the art for a tuning point of monolithic construction that matches the length and balance point of relatively short broadheads.

BRIEF SUMMARY OF THE INVENTION

The present invention specifically addresses and alleviates the above reference deficiencies associated with broadheads and field points. More particularly, the present invention is a broadhead comprising a ferrule with removable blades that are robustly attached to the ferrule. The unique geometry of the broadhead provides a ferrule of substantial length while the blade members provide an effective cutting edge profile for effective harvesting of game. In addition, the cutting edge profile of the blade members facilitates stable and accurate arrow flight. The field point is configured complementary to the broadhead in that the field point has a mass, center of gravity, and length that is matched to the broadhead for tuning an archery bow from which the broadhead may be shot.

The blade members extend radially outwardly from the ferrule. The ferrule has a mating end and a tip end with a longitudinal axis extending therebetween. The tip end of the ferrule may have a series of tip flats spaced about the ferrule and which converge to a sharpened point to facilitate penetration of the broadhead into game. An outer surface of the ferrule may include a plurality of ridges formed thereon with each ridge being separated by a trough such that the ferrule has a tri-ovally shaped cross section. In general, sharp corners of the outer surface between the ridges and the troughs of the ferrule may be radiused in order to reduce weight and increase the overall strength of the ferrule.

Each one of the ridges may have an axially aligned elongate blade groove formed therein. Each one of the blade grooves may generally span a distance along the ferrule from the mating end to the tip end. The ferrule may include a conical flare extending from the outer surface of the ferrule to the mating end of the ferrule. The blade grooves may generally extend along a distance from the flare to the tip flats. Each one of the blade grooves may have an outer groove portion and an inner groove portion disposed radially inwardly from the outer groove portion. A width of the inner groove portion is preferably larger than that of the outer groove portion so that each one of the blade grooves defines a T-shaped cross section.

The broadhead includes a plurality of the blade members that are preferably equal in number to the quantity of blade grooves. Each one of the blade members has a generally sharpened cutting edge, a trailing edge and a base portion. The base portion is preferably shaped complementary to that of the blade groove in that the base portion has a T-shaped cross section similar to that described above for the blade grooves. Each one of the blade members is axially insertable into a corresponding one of the blade grooves in an axial direction from the mating end toward the tip end.

Each one of the blade members may be divided into a first portion and a second portion at a point approximately midway along the base portion. The cutting edge of the first portion is inclined at a first angle relative to the longitudinal axis. The cutting edge of the second portion is inclined at a second angle relative to the longitudinal axis. The first angle is relatively small in relation to the second angle in order to allow the broadhead to rapidly and easily penetrate the generally elastic nature of living animal hide. The first angle of the cutting edge may be oriented at about ten degrees. The second angle of the cutting edge is steeply angled relative to the first angle. The second angle may be oriented at about sixty degrees.

A relatively large concave inner radius provides a transition between the cutting edge of the first and second portions. The inner radius may preferably be about 0.38 inches. The second portion of the cutting edge transitions into the trailing edge by means of an outer radius at a blade tip of the blade member. The outer radius is preferably smaller in size than the inner radius. The relatively large inner radius and the steep inclination of the second angle results in stretching of the hide and cutting of deep wound channels while the broadhead enters and passes through an interior of the animal.

Each one of the first and second portions defines a surface area that has a geometric center which is offset from the longitudinal axis. The blade members are configured such that the amount of offset of the geometric center of the second portion is substantially greater than that of the first portion. The reduced surface area of the first portion reduces aerodynamic drag as well as minimizing wind planing of the arrow. The blade members and ferrule may be formed by any number of fabrication means including, but not limited to, machining, casting and metal injection molding.

The mating end of the ferrule may include a shank extending axially outwardly therefrom. The arrow may have a shaft with a shaft bore. The shank may include a threaded section formed on an extreme end to allow the shank to be threadably engaged to mating threads formed in the shaft bore. The shank may include an enlarged diameter shoulder portion formed thereon proximate the mating end which may include a ring groove formed therearound to receive an O-ring therein. The O-ring is preferably sized to create an interference fit between the shoulder portion and the shaft bore when the threaded section is threadably engagable thereinto. The O-ring acts to center the shank in the shaft-bore and to axially align the broadhead with the arrow for consistency in the flight pattern of the arrow.

An annular collar may be mounted on the shoulder portion. The collar is captured between an end of the shaft and the mating end of the ferrule and acts to retain the blade members within the ferrule by preventing axial movement of the blade members when the base portion of a blade member is inserted into a blade groove. The ferrule and shank may be formed using metal injection molding techniques which may include the use of a powdered composition that is sintered at an elevated temperature.

The field point is specifically configured to be complementary to the broadhead in that the field point has a mass, center of gravity, and length that is matched to the broadhead disclosed herein so that an archer may use the field point to tune an archery bow from which the broadhead may ultimately be shot. The field point comprises an elongate ferrule which lacks blade grooves. The field point may generally comprise a tip portion, an intermediate portion and a rear portion. The tip potion may be conically shaped and converges to a point.

The intermediate portion is disposed between the tip portion and the rear portion and may also have a conical shape. The rear portion is disposed adjacent to the mating end and may be generally cylindrically shaped with an outer diameter thereof being equivalent to an outer diameter of the shaft of the arrow. The field point may include a shank with a threaded section and a shoulder portion. The ring groove may be formed in the shoulder portion to receive the O-ring so as to prevent relative motion between the field point and the shaft of the arrow.

BRIEF DESCRIPTION OF THE DRAWINGS

These as well as other features of the present invention will become more apparent upon reference to the drawings wherein.

DETAILED DESCRIPTION OF THE INVENTION

Figure 13A:
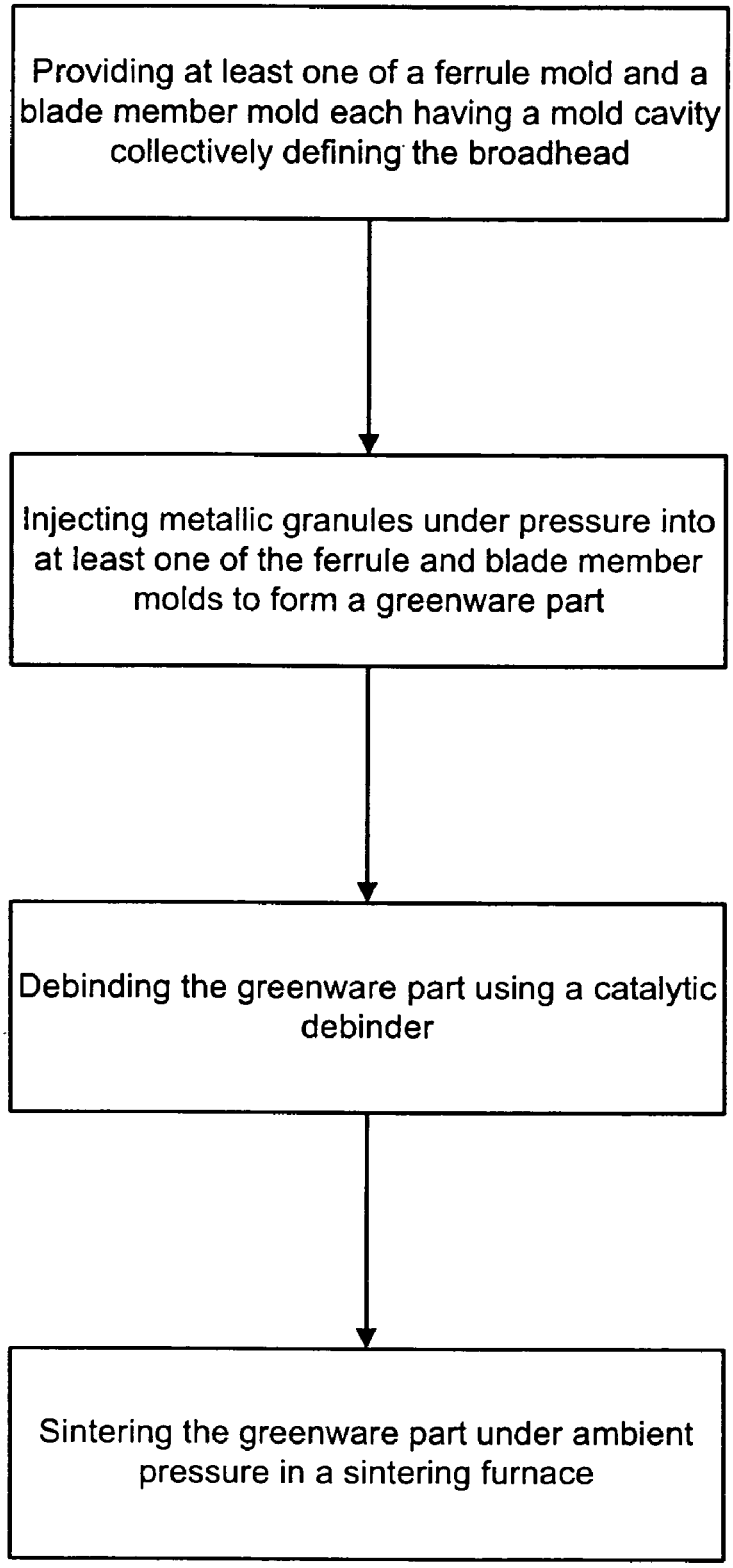
FIG. 13*a* is a block diagram of a metal injection molding ("MIM") process as may be used in manufacturing the broadhead of the present invention.
Figure 13B:
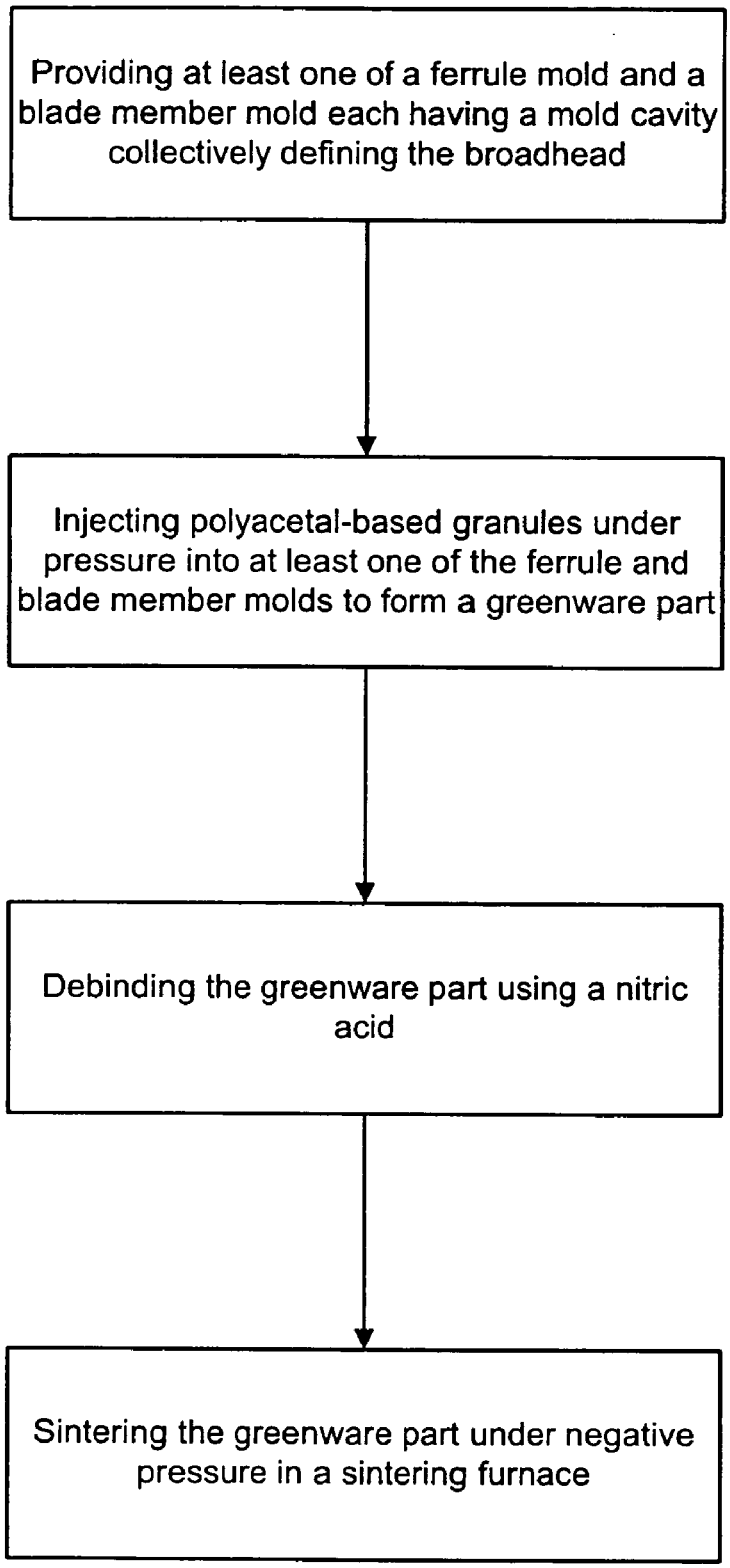
FIG. 13*b* is a block diagram of the MIM process wherein polyacetal granules are used to form a greenware part and wherein nitric acid is used as a catalytic debinder during a debinding step of the greenware part.
Figure 14:
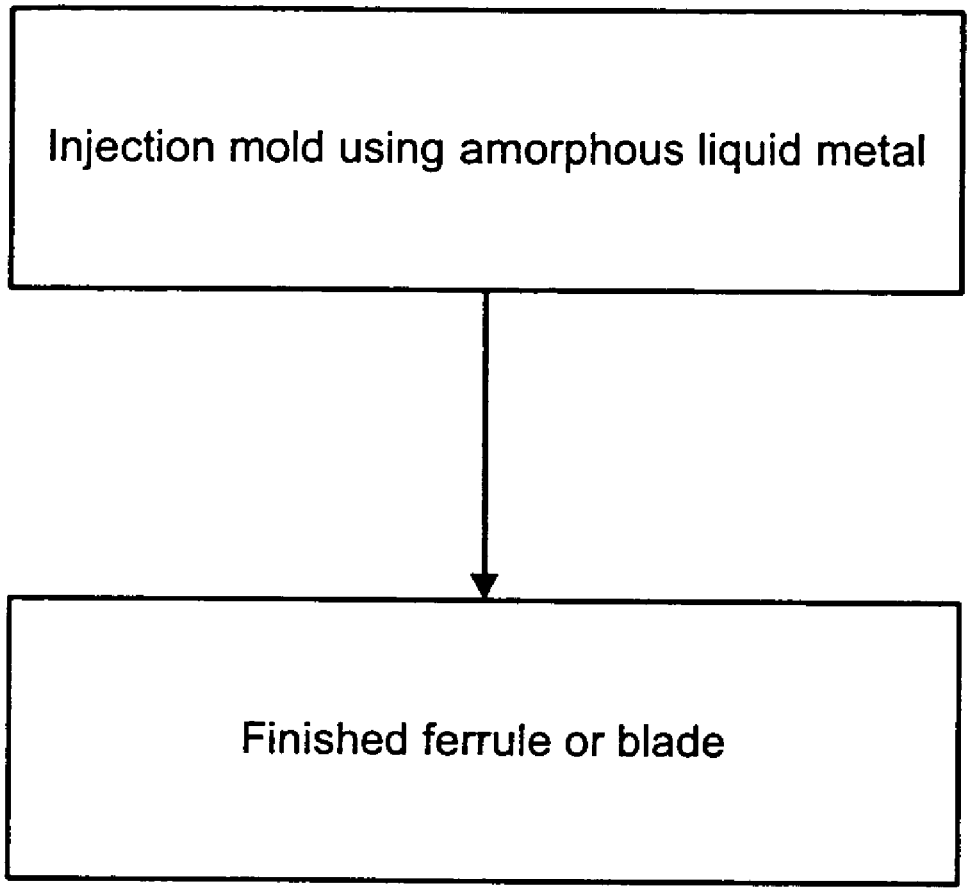
FIG. 14 is a block diagram illustrating a liquid metal molding process as may be used to manufacture the broadhead of the present invention.

Referring now to the drawings wherein the showings are for purposes of illustrating the present invention and not for purposes of limiting the same, FIGS. 1–7 illustrate a broadhead 10 of the present invention as may be mounted on an archery arrow 70. FIGS. 8–12 illustrate a field point 90 that is configured complementary to the broadhead 10 described herein in that the field point 90 has a mass and center of gravity that is substantially matched to the broadhead 10. The field point 90 may be generally provided as a tool for tuning the archery bow from which the broadhead 10 may be shot, as will be described in greater detail below. FIGS. 13*a*, 13*b* and 14 illustrate two methods of manufacture for the broadhead 10.

Figure 7:
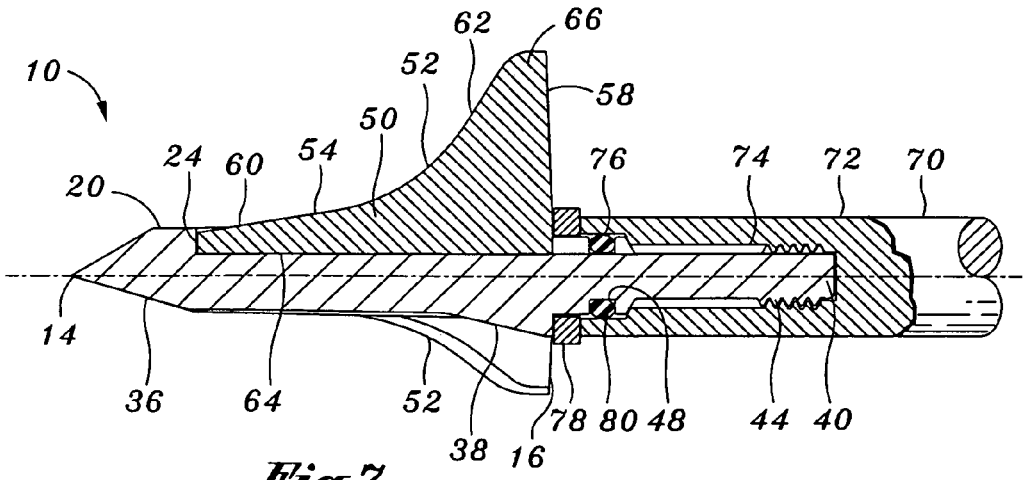
FIG. 7 is a section view of the broadhead secured to an arrow taken along lines 7—7 of FIG. 6 and illustrating an O-ring captured between the shank and an arrow counterbore of the shaft.
Figure 8:
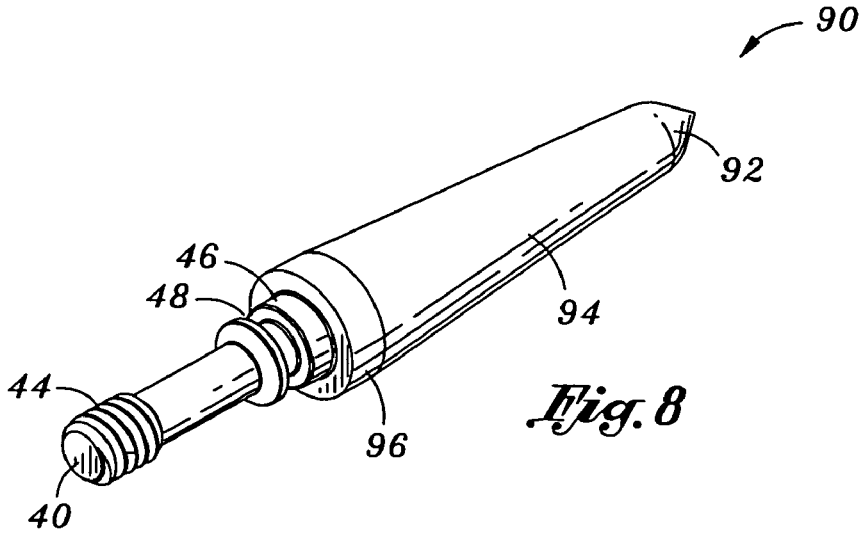
FIG. 8 is a perspective view of a field point of the present invention.
Figure 9:
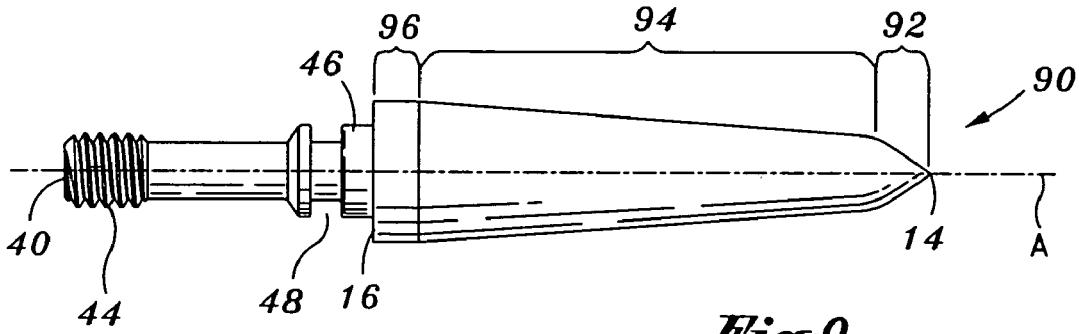
FIG. 9 is a side view of the field point illustrating a shank extending from the ferrule and further illustrating a ring groove and a threaded section formed on the shank.
Figure 10:
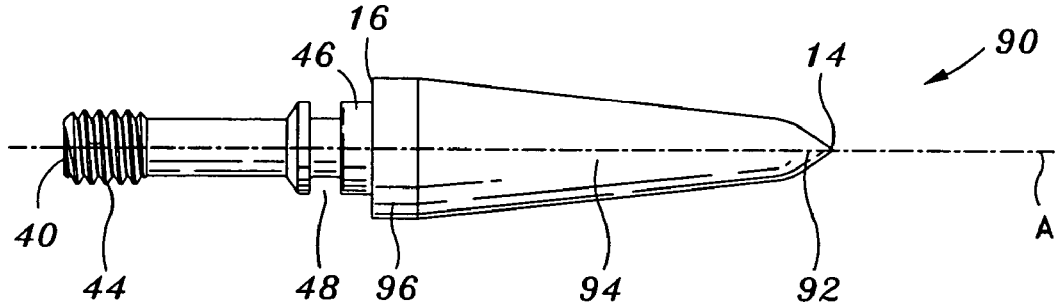
FIG. 10 is a section view of the field point in an alternative size.
Figure 11:
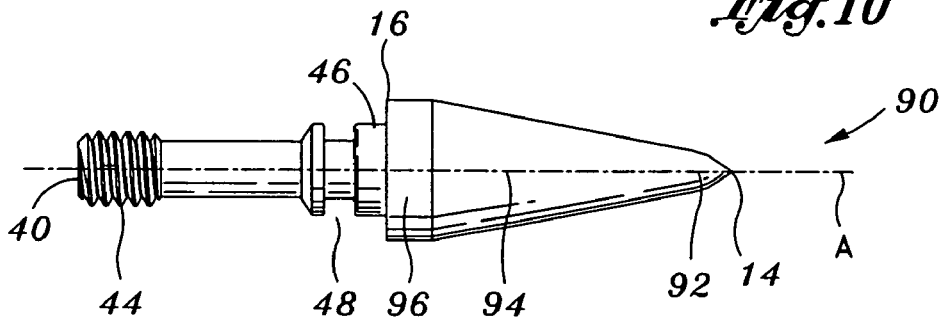
FIG. 11 is a side view of the field point in a further alternative size.
Figure 12:
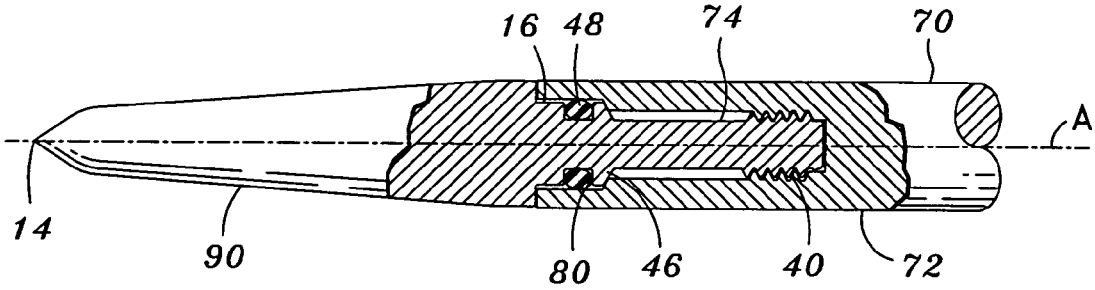
FIG. 12 is a side view of the field point illustrating the O-ring installed in the ring groove.

As shown in FIG. 7, the broadhead 10 may be threadably engaged to an arrow shaft 72 of the arrow 70. In its broadest sense, the broadhead 10 comprises an elongate ferrule 12 with removable blade members 50 that extend radially outwardly from the ferrule 12. The unique configuration of the blade members 50 and the manner in which they attach to the ferrule 12 results in a robust broadhead 10 capable of withstanding impact with relatively hard objects. In addition, the broadhead 10 is configured to provide a substantially long length ferrule 12 while keeping the broadhead 10 within established weight classifications for archery. Furthermore, the unique profile of the blade members 50 allows for stable and accurate arrow 70 flight without wind planing. Other advantages of the broadhead 10 will become apparent in the description that follows.

Figure 1:
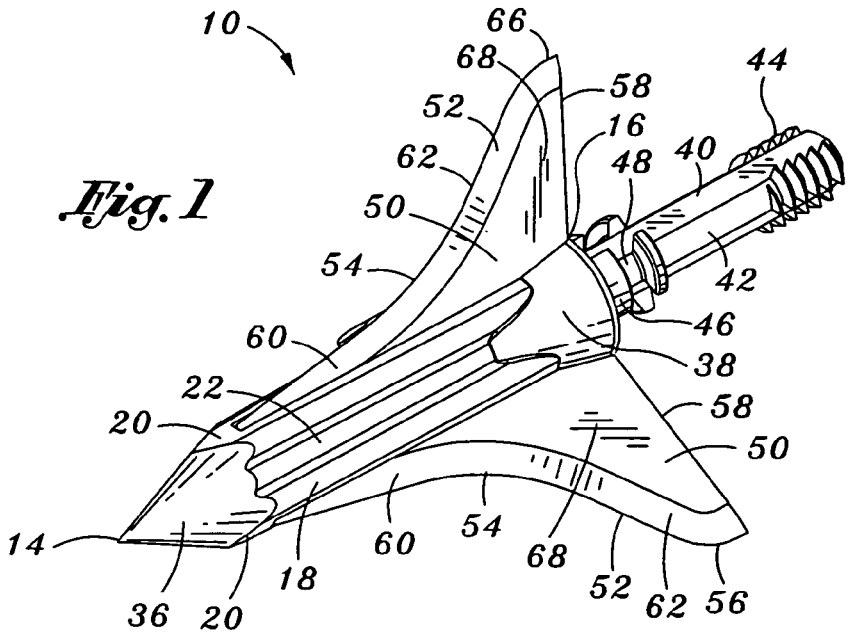
FIG. 1 is a perspective view of a broadhead of the present invention illustrating a ferrule and blade members extending radially outwardly therefrom.
Figure 2:
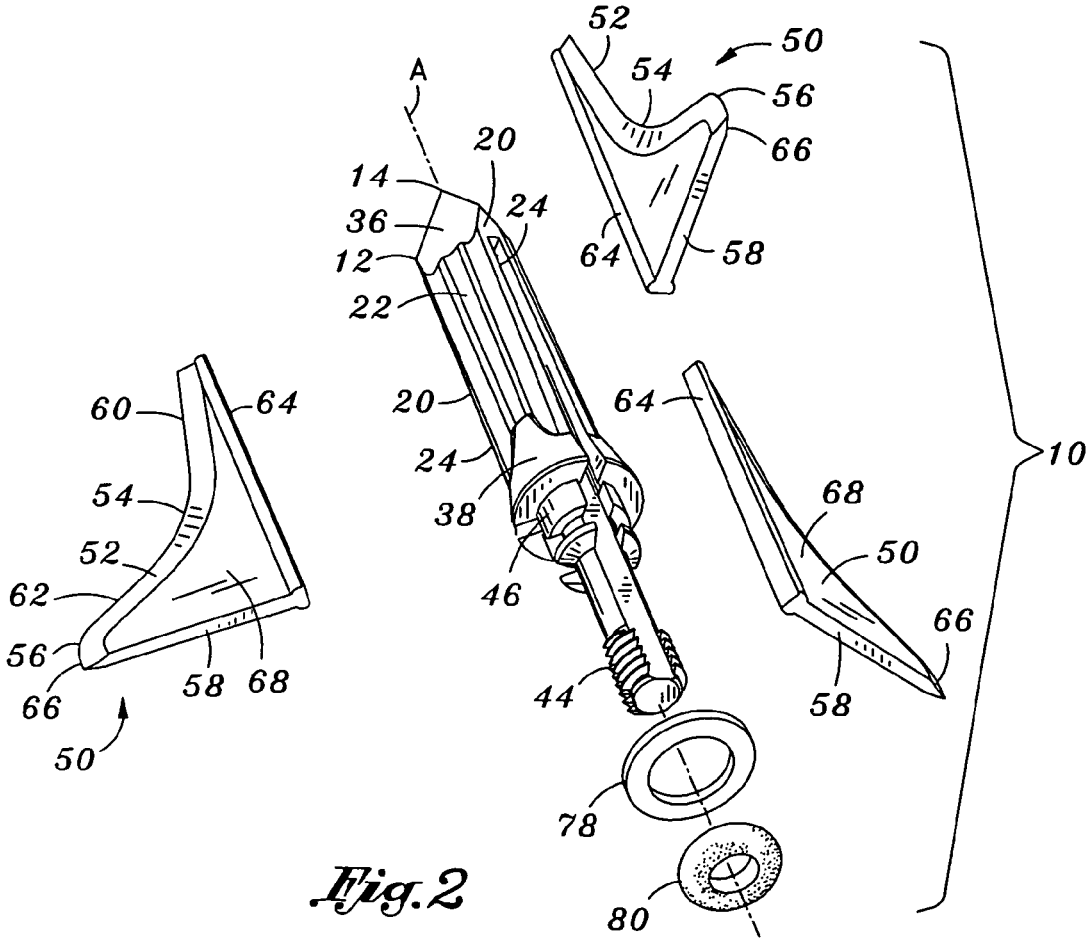
FIG. 2 is an exploded perspective view of the broadhead illustrating the interconnectivity of the blade members with blade grooves that are formed in the ferrule.
Figure 3:
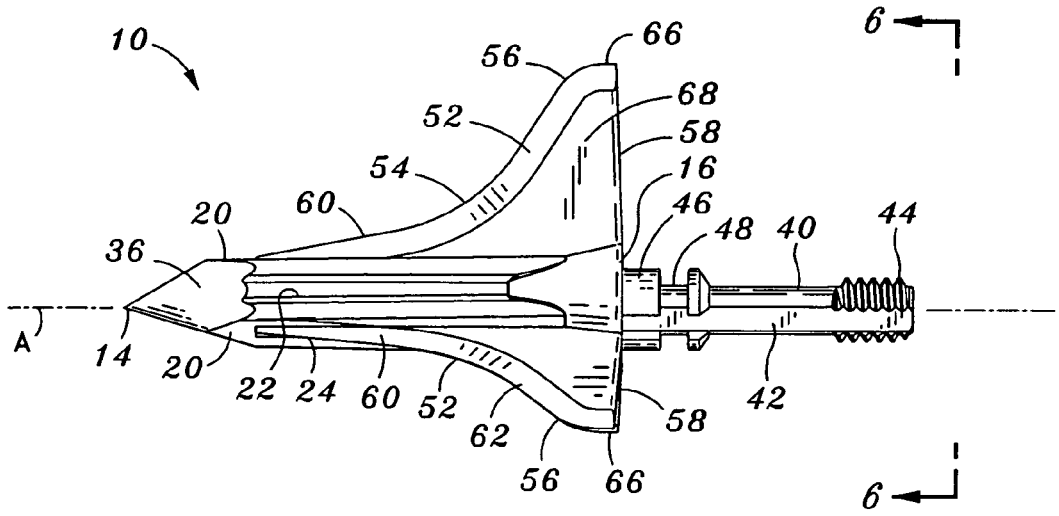
FIG. 3 is a side view of the broadhead having a shank extending axially outwardly therefrom at a mating end of the ferrule.
Figure 5:
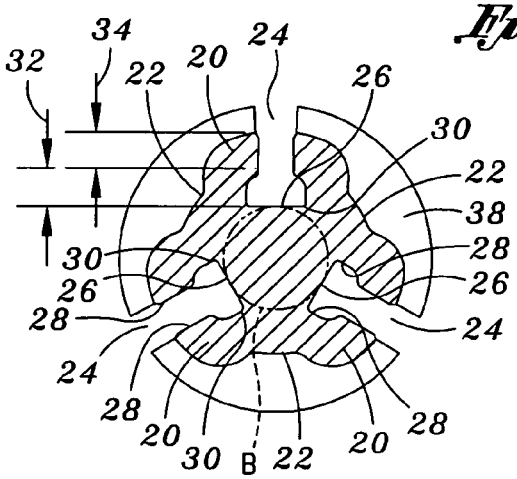
FIG. 5 is a cross sectional view of the ferrule taken along lines 5—5 of FIG. 4 and illustrating a T-shaped cross section of each one of the blade grooves.

As shown in FIGS. 1–7, the ferrule 12 has a mating end 16 and a tip end 14 with a longitudinal axis A extending between the mating end 16 and the tip end 14. The deepest surface or the surface closest to the ferrule's longitudinal axis A, is illustrated in FIGS. 1–7 as a trough 22 which can may be concave, flat or convexly shaped. Although shown as having a series of tip flats 36 equiangularly spaced about the ferrule 12 and converging to a sharpened point, the tip end 14 of the ferrule 12 may alternatively be configured in a simple conical shape which may also converge to a generally sharp point to facilitate penetration of the broadhead 10 into game. As best seen in FIG. 5, an outer surface 18 of the ferrule 12 may preferably include a plurality of generally rounded or convex ridges 20 formed thereon. The ridges 20 may be generally equiangularly spaced around the outer surface 18 of the ferrule 12 and may each be separated by the troughs 22.

In FIG. 5, three ridges 20 are shown equiangularly spaced at intervals of about 120 degrees about the outer surface 18 with each ridge 20 being separated by a trough 22 such that the ferrule 12 generally has a tri-ovally shaped cross section. Although three ridges 20 are shown, any number of ridges 20 may be provided with the ferrule 12. For example, it is contemplated that the ferrule 12 may have anywhere from two to six ridges 20 to accommodate a corresponding number of blade members 50.

It should be noted that the tip flats 36 may be clocked relative to the outer surface 18 such that each one of the troughs 22 has a tip flat 36 extending therefrom. In FIGS. 1–7, each one of the tip flats 36 is oriented at about 17 degrees relative to the longitudinal axis A although the tip flats 36 may be oriented at any angle of inclination. The tip flats 36 converge to a point at an extreme portion of the tip end 14. However, the tip flats 36 may be angularly oriented in a variety of positions relative to the troughs 22 and ridges 20.

Advantageously, the tri-ovally shaped cross section provides a high strength-to-weight ratio for the ferrule 12 compared to a ferrule 12 of cylindrical or conical shape. More specifically, the unique arrangement of the ridges 20 results in the ferrule 12 having a relatively high moment of inertia and improved bending strength. More importantly, the tri-ovally shaped cross section allows for a longer ferrule 12 within a given weight classification as compared to cylindrically or conically shaped ferrules of the prior art.

For a broadhead 10 within a weight classification of about 125 grains, it is contemplated that the ferrule 12 may have an overall length of about 1.22 inches from the mating end 16 to the tip end 14. However, it is recognized herein that the ferrule 12 may be provided in any length. The increased length of the ferrule 12 improves the flight characteristics in cooperation with the blade members 50, as will be described in greater detail below.

Referring to FIG. 5, the specific shape of the ridges 20 and troughs 22 may be as shown where each one of the ridges 20 has a rounded or convex shape with sides of the ridges 20 also being generally rounded and intersecting the troughs 22 on opposite sides of each one of the ridges 20. The troughs 22 may each also have a generally rounded shaped which intersects with the sides of the ridges 20 with an interior convex, concave or flat surface being formed therebetween.

In this regard, sharp corners of the outer surface 18 of the ferrule 12 are preferably minimized or eliminated in order to reduce weight and increase the overall strength of the ferrule 12.

The cross section of the ferrule 12 is preferably generally constant with only a slight taper for fabrication as the ferrule 12 extends between the mating and tip ends 12, 14, as is shown in FIGS. 1–7. However, it is contemplated that the cross section of the ferrule 12 may be provided in a variety of alternative configurations. For example, the cross section of the ferrule 12 may generally taper in size from the mating end 16 toward the tip end 14. However, the cross section of the ferrule 12 may be constant in order to enhance the weight, length, and strength characteristics of the ferrule 12 as well as to simplify fabrication.

Each one of the ridges 20 has an axially aligned elongate blade groove 24 formed therein. If the ferrule 12 is provided in a cylindrical or conical shape, the blade grooves 24 may be equiangularly spaced about the outer surface 18 of the ferrule 12. However, for the configuration shown in FIGS. 1–7, each one of the blade grooves 24 may be generally centered on the ridge 20 and may extend partially radially inwardly from the outer surface 18 toward an inner portion of the ferrule 12. As shown in FIGS. 1–4, each one of the blade grooves 24 may generally span a length of the ferrule 12 from the mating end 16 to the tip end 14.

The ferrule 12 may include a conical flare 38 located adjacent the mating end 16. The flare 38 may extend from the outer surface 18 of the ferrule 12 up to a maximum diameter of the flare 38 preferably being complementary to an outer diameter of the arrow shaft 72. The blade grooves 24 may generally extend along a distance from the flare 38 to the tip flats 36, as is shown in FIGS. 1–7. For the broadhead 10 within the weight classification of about 125 grains, it is contemplated that each one of the blade grooves 24 may have a length of about 0.96 inches from the mating end 16 to the tip flats 36.

Referring to FIG. 5, each one of the blade grooves 24 may have an outer groove portion 34 and an inner groove portion 32. The inner groove portion 32 is disposed radially inwardly from the outer groove portion 34 of the blade groove 24 wherein a width of the inner groove portion 32 is larger than that of the outer groove portion 34 so that each one of the blade grooves 24 defines a T-shaped cross section. As shown in FIG. 5, each one of the blade grooves 24 has a pair of opposing groove sides 28 extending from the outer surface 18 to a generally flat or planar groove bottom 26. Groove corners 30 that form the transition from groove bottom 26 to groove sides 28 are preferably radiused as shown in FIG. 5 in order to eliminate stress risers that may otherwise lead to structural failure of the ferrule 12 upon impact with a hard object. In addition, the radius between groove bottom 26 and groove sides 28 allows for a narrow cross section of the ferrule 12 which, in turn, allows for a longer ferrule 12.

The depth at which the groove bottoms 26 are radially spaced from the longitudinal axis A is equal to or less than about one-half of the minor thread diameter B of the threaded section 44 of shank 40. The preferred size of the threaded section 44 of the shank 40 is a #8 unified coarse screw thread although the threaded section 44 can be in varying screw thread sizes. In the case of the preferred # 8 unified course screw thread, the minor thread diameter B of the threaded section 44 of shank 40 is 0.1257 inches. As such, the groove bottoms 26 are preferably tangent to the minor thread diameter B. Therefore, the amount by which the groove bottoms 26 are offset from the longitudinal axis A is preferably equal to or less than 0.06285 inches (i.e., one-half of 0.1257 inches), as is illustrated in FIG. 5.

As can be seen, each one of the groove sides 28 includes a joggle to separate the inner groove portion 32 from the outer groove portion 34. The joggle in the groove sides 28 is preferably also radiused in order to eliminate stress risers. A gap between the groove sides 28 at the outer groove portion 34 is preferably less than that at the inner groove portion 32 such that the blade groove 24 defines the T-shaped cross section. In addition, the gap between the groove sides 28 at the outer groove portion 34 is preferably sized to be slightly greater than a thickness of the blade member 50.

Although each one of the blade grooves 24 may have a generally constant cross section along its length, the width and height of the T-shaped cross section of the blade groove 24 is preferably configured to gradually increase in size along a direction from the tip end 14 toward the mating end 16. Such tapering of the cross section of the blade groove 24 allows for corresponding tapering of the blade member 50 at the base portion 64. The gradual taper of blade groove 24 and the corresponding tapering of blade member 50 enables the ferrule 12 and shank 40 to be molded as a unitary body. The tapering of blade groove 24 and blade member 50 also makes the mating and removal of blade member 50 from ferrule 12 may be facilitated in an easy fashion.

More specifically, tapering of the cross section allows a forward portion of the blade member 50 to be narrower than an aft portion of the blade member 50. Such tapering ultimately allows for a longer ferrule 12 which improves the aerodynamicity of the broadhead 10 in addition to other benefits. Tapering of the blade member 50 also enhances the strength of the broadhead 10 because the aft portion of the blade member 50 is widest where stresses are greatest. Tapering of the cross section of the blade groove 24 with a complementary tapering of the blade member 50 also improves blade retention within the blade groove 24.

Figure 4:
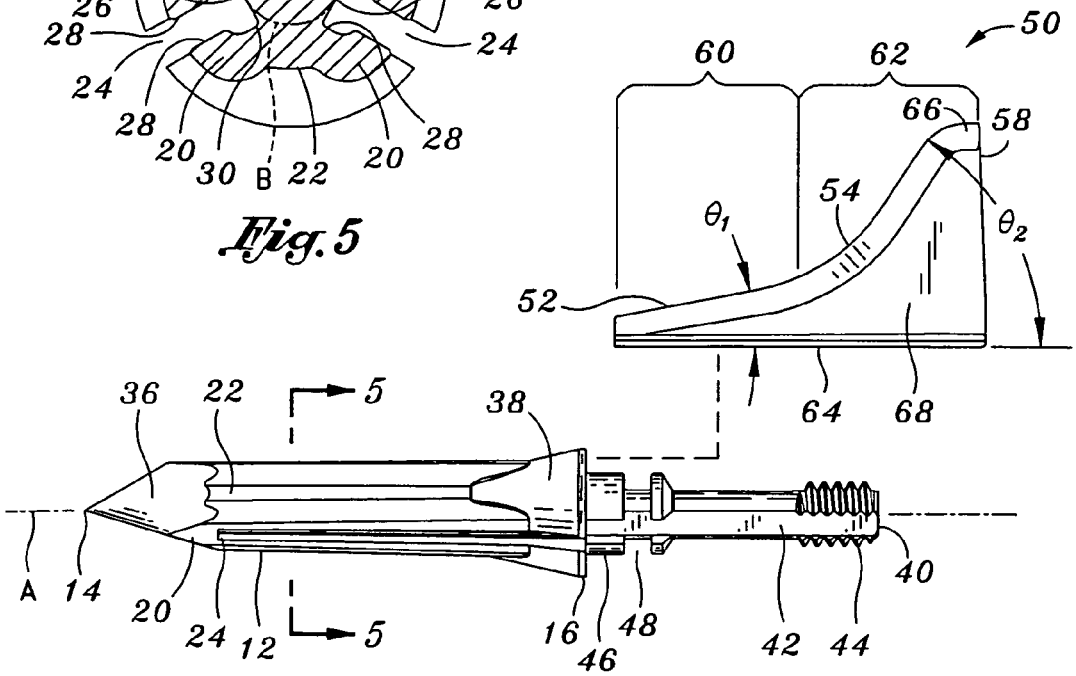
FIG. 4 is an exploded side view of the broadhead illustrating one of the blade members which may be inserted into a blade groove at the mating end of the ferrule.
Figure 6:
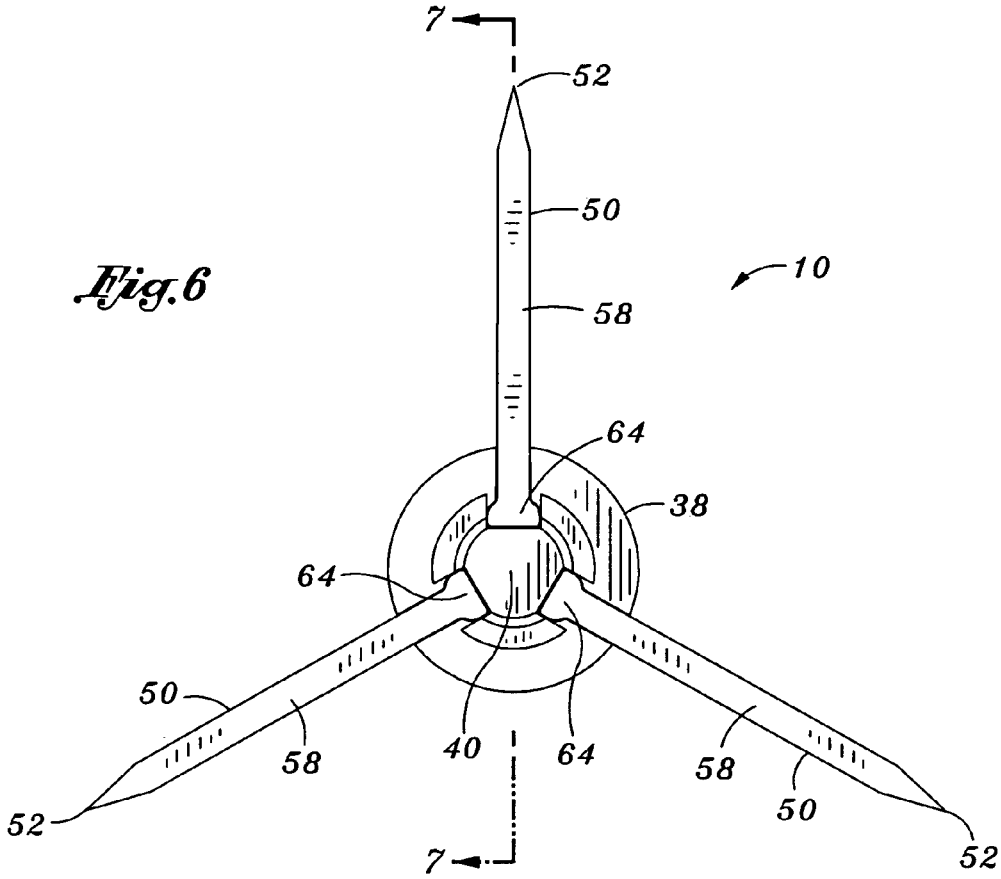
FIG. 6 is an aft view of the broadhead taken along lines 6—6 of FIG. 3 and illustrating shank guides formed in the shank for axial insertion and removal of the blade members from the blade grooves.

Referring still to FIGS. 1–7, the configuration of the blade members 50 will be described. As was earlier mentioned, the broadhead 10 includes a plurality of the blade members 50 that are preferably equal in number to the quantity of blade grooves 24. The blade members 50 may be generally planar although it is contemplated that the blade member 50 may have alternative shapes and/or may include surface features on blade sides surfaces 68. As shown in FIG. 4, each one of the blade members 50 has a generally sharpened cutting edge 52, a trailing edge 58 and a base portion 64.

The base portion 64 is preferably shaped complementary to that of the blade groove 24 in that the base portion 64 has a T-shaped cross section similar to that described above for the blade grooves 24. The T-shaped cross section of the blade groove 24 extends axially outwardly passing through the flare 38 at the mating end 16 of the broadhead 10. In this manner, each one of the blade members 50 is axially insertable into a corresponding one of the blade grooves 24 in an axial direction from the mating end 16 toward the tip end 14. When installed into the ferrule 12, each one of the blade members 50 extends radially outwardly from the ferrule 12 as shown in FIGS. 1–7.

As shown in FIG. 4, each one of the blade members 50 comprises a first portion 60 and a second portion 62 which are generally divided at a point approximately midway along the base portion 64. The base portion 64 generally has a T-shaped cross section. The bottom of the blade base 64 is flat, concave, or convex over its entire length. This flat, concave, or convex blade base 64 is the mating surface which mates with groove bottom 26. The first and second portions 60, 62 are therefore respectively located adjacent the tip end 14 and the mating end 16 of the ferrule 12 when the blade member 50 is installed therein. Part of the cutting edge 52 is therefore located in the first portion 60 while the remainder of the cutting edge 52 is located within the second portion 62. The cutting edge 52 of the first portion 60 is inclined at a first angle $\theta_1$ relative to the longitudinal axis A. The cutting edge 52 of the second portion 62 is inclined at a second angle $\theta_2$ relative to the longitudinal axis A.

As shown in FIG. 4, the first angle $\theta_1$ is relatively small in order to allow the broadhead 10 to rapidly and easily penetrate the generally elastic nature of living animal hide. As shown in FIG. 4, the first angle $\theta_1$ of the cutting edge 52 may be less than about fifteen degrees and more preferably may be about ten degrees. By orienting the first portion 60 of the cutting edge 52 at such a shallow angle, the broadhead 10 may rapidly penetrate and cut a maximum amount of the elastic animal hide during initial contact of the broadhead 10 with the hide. In addition, the relatively long length of the first portion 60 cutting edge 52 allows for effective piercing of internal tissue of the animal such as tendons, arteries, veins, muscle and fat as the broadhead 10 passes through the animal interior. In addition, by orienting the first portion 60 of the cutting edge 52 at such a shallow angle, the overall weight of blade member 50 is reduced allowing the blade to be lighter which ultimately allows the broadhead 10 to be lengthened.

The second angle $\theta_2$ of the cutting edge 52 is steeply angled relative to the first angle $\theta_1$. Generally, the second angle $\theta_2$ may be oriented to be in the range of from about four to eight times as great as the first angle $\theta_1$. Specifically, the second angle $\theta_2$ may be oriented to be within the range of from about fifty degrees to about eighty degrees although any angular orientation may be provided for the second angle $\theta_2$. More preferably, the second angle $\theta_2$ may be oriented at about sixty degrees as shown in FIGS. 1–7.

A relatively large concave inner radius 54 of the blade member 50 provides a transition between the first portion 60 and the second portion 62. The inner radius 54 may be in the range of from about 0.15 to about 0.75 inches but preferably may be about 0.38 inches as is shown in FIG. 4. The second portion 62 of the cutting edge 52 transitions into the trailing edge 58 with a convex or outer radius 56 at a blade tip 66 of the blade member 50. The outer radius 56 is preferably smaller in size than the inner radius 54. Advantageously, the relatively large inner radius 54 and the steep inclination of the second angle $\theta_2$ results in stretching of the hide while the broadhead 10 passes therethrough. The outer radius 56 adds width and therefore material to the outermost cutting surface which adds strength to the blade at its outermost edge. Radius 56 ads strength to blade 50 at its cutting edge located farthest from the longitudinal axis of broadhead 10.

In addition, the large inner radius 54 and the steep inclination of the second angle $\theta_2$ result in a total length of cutting edge 52 which is about fifteen percent greater than a straight-line distance from a forward-most portion of the blade member 50 to an aft-most portion (i.e., the blade tip 66) of the blade member 50. In this regard, the large inner radius 54 and the steep inclination of the second angle $\theta_2$ cooperate to generate entrance and exit wounds that are larger in diameter than a diameter circumscribing the blade members 50 when viewed in an axial direction. Such large entrance wounds increase the rate of blood loss resulting in a humane and swift expiration of the animal.

As shown in FIG. 4, the portion of the blade member 50 protruding out of the ferrule 12 defines a pair of opposing side surfaces 68. Each one of the first and second portions 60, 62 defines a surface area that has a geometric center which is offset from the longitudinal axis A. The blade members 50 are configured such that the amount of offset of the geometric center of the side surface 68 of the second portion 62 is substantially greater than the offset of the geometric center of the first portion 60. Such a configuration reduces the amount of surface area at the first portion 60 which has the effect of reducing aerodynamic drag.

The reduced aerodynamic drag of the first portion 60 allows the arrow 70 to better retain its down range velocity with an improved penetration of game at such down range distances. In addition, the reduced amount of surface area of the first portion 60 also has the effect of reducing wind planing. In addition, the configuration of the cutting edge 52 concentrates the surface area at the second portion 62 which, in turn, results in a large cutting width. By configuring the blade members 50 in this manner, any tendency for the arrow 70 to porpoise, fishtail or wind plane is generally minimized.

It should be noted that although the blade members 50 are shown as being removable, it is contemplated that the blade members 50 may be permanently attached to the ferrule 12. In this regard, it is contemplated that the blade members 50 and ferrule 12 may be fabricated as a unitary structure wherein the ferrule 12 lacks blade grooves 24 and the blade members 50 lack the base portion 64. Instead, the blade members 50 may be directly formed as part of the ferrule 12 using any number of fabrication techniques including, but not limited to, machining, casting, liquid metals injection molding ("LMM"), and metal injection molding ("MIM"). The blade members 50 and ferrule 12 may be configured with the specific geometries described above so as to provide the performance advantages exhibited by broadheads 10 having removable blade members 50.

Referring still to FIGS. 1–7, the mating end 16 of the ferrule 12 may include a reduced diameter shank 40 extending axially outwardly therefrom in order to provide a mechanism with which to secure the broadhead 10 to the arrow shaft 72. Although shown as having a length of about 0.68 inches, the shank 40 may be provided in any length. As shown in FIG. 4, the arrow shaft 72 includes a shaft bore 74. The shank 40 may include the threaded section 44 formed on an extreme end thereof to allow the shank 40 to be threadably engaged to mating threads formed in the shaft bore 74.

At least one and, preferably, a plurality of shank guides 42 may be formed on the shank 40. The shank guides 42 are provided equal in number to and in general alignment with the blade grooves 24 to provide clearance for the blade members 50 so as to allow for insertion and removal of the blade members 50 from the mating end 16 of the ferrule 12. The shank guides 42 may be formed on the shank 40 so as to be in generally axial alignment with the blade grooves 24. The shank guides 42 are configured to provide clearance for the blade members 50 during insertion into and removal from the blade grooves 24.

The shank guides 42 also minimize the overall mass of the broadhead 10. The shank guides 42 are preferably located such that each one of the shank guides 42 are offset at equal distances from the longitudinal axis A of the broadhead 10. As was earlier mentioned, the groove bottoms 26 are also preferably tangent to the minor thread diameter B. Since the shank guides 42 are located at or below the minor thread diameter B, the shank guides 42 allow the blade grooves 26 to be located nearer to the longitudinal axis A. Since the blade groove bottoms 26 are not constrained by the external diameter of the threaded section 44 and are placed at a lesser diameter than the minor thread diameter B, the diameter of the ferrule 12 may be reduced which enables the ferrule 12 to be lengthened to meet a particular design weight.

A long ferrule 12 and corresponding long blade members 50 are desirable for reasons stated earlier. A width of the shank guides 42 is preferably slightly wider than a width of the blade base 64. Since the shank guides 42 are placed at a depth which is equal to or less than the minor thread diameter B, the shank guides 42 reduce the mass of the shank 40 over the entire length of the shank 40 and allows the removed material weight to be added to a tip end 14 of the ferrule 12 which increases the overall length of the ferrule 12.

The shank guides 42 are important to the fabrication of the ferrule 12 and enable the ability to utilize MIM or LMM to create a monolithic broadhead ferrule 12 with rear entry T-shaped blade grooves 24 wherein the threaded section 44 is formed with or without the need to machine or form threads and allow the blade members 50 to pass through the threaded section 44. The shank guides 42 provide a path for blade members 50 to follow as they are inserted or removed from the blade groove 24.

The shank guides 42 are equal in number to blade grooves 24 and are equal in number to the number of side pulls that may be included in an injection mold used to mold the ferrule 12. The shank guide 42 provides a travel path for T-shaped mold inserts which create the T-shaped blade grooves 24 of the ferrule 12. The shank guide 42 allows the blades members 50 to pass through the threaded shank 44 for insertion or removal from the blade grooves 24. The shank guide 42 removes mass from the shank 44 end of the ferrule 12 which allows the mass to be added to the tip 14 end of the ferrule and the overall length is increased which is desired.

A circumferential ring groove 48 may be formed in the shank 40 to allow a resilient O-ring 80 to be mounted therein. The O-ring 80 is captured between the shank 40 and the shaft bore 74 and prevents relative movement which may undesireably lead to loosening of the broadhead 10 with resulting adverse impact on the flight characteristics of the arrow 70. Preferably, the shank 40 may include an enlarged diameter shoulder portion 46 formed thereon proximate the mating end 16, as shown in FIGS. 1–7. The shoulder portion 46 may include the ring groove 48 formed therearound.

The ring groove 48, when formed in the enlarged diameter shoulder portion 46, reduces the weight of the shank 40 since O-ring material is generally significantly lighter than the metal used to form the shank 40. The metal removed to form the ring groove 48 is added to the tip end 14 of the ferrule 12 to increase its overall length. The circumferential ring groove 48 is preferably sized to closely match the size of the O-ring 80 as shown in FIG. 7. However, the width of the ring groove 48 can be much wider than shown so as to support the O-ring 80 from only one side when tightening or loosening the broadhead 10.

A shaft counterbore 76 may be concentrically formed on an extreme end of the shaft 72 to receive the shoulder portion 46 and O-ring 80 therein. The O-ring 80 is preferably sized to create a frictional fit or interference fit between the shoulder portion 46 and the shaft counterbore 76 when the threaded section 44 is threadably engagable thereinto. In this manner, the O-ring 80 acts to center the shank 40 in the shaft bore 74 which, in turn, axially aligns the broadhead 10 with the arrow 70 for consistency in the flight pattern of arrows 70 carrying the broadhead 10. Furthermore, the O-ring 80 prevents the broadhead 10 from rattling or vibrating loose from the arrow 70 while in storage or while in flight.

In addition, the resilient O-ring 80 provides some shock isolation or attenuation characteristics to the broadhead 10 should the broadhead 10 strike a rock or other hard object. In this regard, the O-ring 80 prevents the broadhead 10 from becoming loosened on the arrow 70 during impact. The O-ring 80 also eliminates the possibility of a loss of one of the blade members 50 by restricting axial movement that is otherwise necessary for extrication of the blade members 50. Finally, the O-ring 80 prevents moisture entry into a gap between the shank 40 and the shaft bore 74.

The O-ring 80, when installed in the circumferential ring groove 48 on the broadhead 10, enables the broadhead 10 to be stored in its assembled condition. The blade members 50 cannot slide axially when the O-ring 80 is installed in its ring groove 48. The blade base 64 interferes with the O-ring 80 and, as such, axial movement of the blade 50 is prevented by the O-ring 80. If the assembled broadhead 10 is mistakenly dropped, the broadhead 10 will remain intact. In addition, the annular collar 78 is designed in a way such that its inner diameter is smaller than an outside diameter of the O-ring 80. This allows the annular collar 78 to be held in place on the broadhead 10.

Because the end of the shaft 72 is typically of metallic construction (e.g., aluminum) while the broadhead 10 is typically of a dissimilar metal (e.g., a steel alloy), the O-ring 80 also prevents dissimilar metal corrosion that may otherwise occur. Such corrosion, if it were to occur, may have the undesirable effect of binding the broadhead 10 to the shaft 72. The O-ring 80 may be fabricated from a number of resilient or elastic materials such as polymeric material. Such polymeric material may preferably include Buna-N, Silicon, Neoprene, ethylene propylene dieneterpolymer (EPDM) which has a high cycle life, excellent abrasion resistance properties and favorable performance at low and high temperatures.

As is shown in FIG. 7, an annular collar 78 may be included with the broadhead 10. The collar 78 is configured to be mountable on the shank 40 and captured between the O-ring 80 and the mating end 16. More specifically, the collar 78 may be mounted on the shoulder portion 46 of the shank 40 and has an outer diameter that is preferably less than that of the largest diameter of the flare 38. The collar 78 is preferably captured between an end of the shaft 72 and the mating end 16 of the ferrule 12. The collar 78 axially retains the blade members 50 within the ferrule 12 by restricting or preventing axial movement of the blade members 50 when the base portions 64 are inserted into a respective one of the blade grooves 24.

Referring now to FIGS. 13*a*, 13*b* and 14, the ferrule 12 and shank 40 are preferably formed as a unitary structure. It is contemplated that the ferrule 12 and shank 40 are formed using amorphous or liquid metals molding ("LMM"), metal casting, MIM, and/or metal machining. More specifically, MIM is a preferred manufacturing process. The BASF Catamold MIM process, as disclosed in U.S. Pat. No. 5,860,055, issued to Hesse et al. and incorporated by reference herein in its entirety, is preferred because it requires only three (3) processing steps including; 1. Injection molding; 2. Catalytic debinding; and 3. Sintering.

Continuous MIM manufacturing of the broadhead 10 is enabled by injection molding greenware ferrules 12 using ready to mold BASF Catamold granules with a polyacetal binder and are manufactured as disclosed in U.S. Pat. No. 5,860,055. Injection molding using ready-to-mold polyacetal based granules eliminates any requirement to mix, blend, or pelletize components as is disadvantageously required in the power injection molding process of U.S. Pat. No. 6,290,903 issued to Grace.

Referring more particularly now to FIGS. 13*a* and 13*b*, shown are block diagrams of the MIM process as may be used in manufacturing the broadhead 10 described in detail above. In the MIM process illustrated in FIGS. 13*a* and 13*b*, the method comprises the steps of providing at least one of a ferrule mold and a blade member mold each having a mold cavity that collectively defines the broadhead. Metallic granules are then injected under pressure into at least one of the ferrule and blade member molds in order to form a greenware part. The granules may be polyacetal-based granules and are preferably formed of a generally homogeneous mixture of finely-divided powders, binders and additives.

Because the metallic granules include binders that hold the greenware part together, it is necessary to remove the binder. It is contemplated that the catalytic debinder may be nitric acid. Another step in the MIM process then is to debind the greenware part using a catalytic debinder. The greenware part is then sintered under ambient pressure (i.e., zero additional pressure) or slightly negative pressure, in a sintering furnace. During the sintering step, the broadhead attains its final size and mechanical properties.

In the MIM process as disclosed herein, the greenware part of the ferrule 12 has high greenware strength due to the polyacetal binder. The polyacetal binder is removed using the catalytic debinding as disclosed in U.S. Pat. No. 5,531,958, herein incorporated by reference in its entirety. The catalyst is an acid and the preferred acid is nitric acid. The catalytic reaction removes the polyacetal binder and in doing so, does not create any waste bi-products which require disposal. Earlier PIM solvent debinding processes can produce harmful waste bi-products such as heptanes and chlorine which are harmful to the ozone-layer.

However, the catalytic debinding process used in the present application is believed to be superior. Catalytic debinding is completed in a single debinding step which is superior to the two-step PIM solvent debinding process which requires solvent debinding and thermal debinding. Furthermore the catalytic debinding process as used herein debinds the ferrule 12 at a temperature of about 150 degrees Fahrenheit below the softening temperature of the polyacetal binder which maintains strict dimensional control of the ferrule 12 during catalytic debinding.

Advantageously, the catalytic debinding process removes the binder in a direction moving from the outside of the ferrule inward which prevents pressure buildup in the interior of the ferrule 12 which may otherwise cause distortion. Most importantly, during debinding, a binder decomposition front is generated and the binder decomposition front advantageously moves inward at a rate of about 1–2 mm per hour making catalytic debinding about ten (10) times faster than solvent or thermal debinding techniques. Since catalytic debinding is achieved in a single process step, this eliminates the requirement to transfer greenware parts from solvent debinding to thermal debinding as required by PIM, eliminates the capital cost of one additional debinding step while reducing the possibility of damaging the ferrules 12 by transferring them to multiple debinding steps as required by PIM.

This increased debinding rate enables the MIM process to be run in a continuous process where greater overall quality and lower part cost can be attained. The ferrules 12 may be sintered in an ambient pressure or slightly negative pressure furnace at high temperature. The low pressure sintering furnace enables sintering to be completed in a continuous process which improves the overall quality of the ferrule 12 and has the greatest ability to reduce ferrule 12 costs. The MIM three (3) step process is less complex than the PIM seven (7) step process.

The MIM ready-to-mold feedstock allows the ability to injection mold ferrules 12 on a continuous basis while the MIM catalytic debindings ten fold increase in debinding speed enables ferrule 12 debinding to be run on a continuous basis and low pressure sintering furnaces can sinter ferrules 12 on a continuous basis. Thus, using the MIM process as described herein, ferrule 12 throughput is increased while capital expenses are reduced.

Blade member 50 may be formed as a unitary structure in the same manner as was described above for MIM production of the ferrule 12. The ferrule 12 and shank 40 may also be formed as a unitary structure using the above-described MIM process or using an LMM process. However, MIM is the most preferred manufacturing process. LMM may also be used to form the blade member 50 and/or the ferrule 12 and/or the broadhead 10 as a unitary structure. LMM is illustrated in block diagram in FIG. 14. LMM has several process advantages over PIM and MIM. More specifically, in LMM, no processes are required once the molded part is ejected from the mold or casting. In addition, no debinding or sintering is required. On cutting edges 52 such as on blade members 50, no sharpening is believed to be required. These are significant process improvements when compared to PIM or MIM.

LMM can use traditional injection molding techniques as well as casting techniques. LMM has the potential to replace MIM and become the preferred molding technology to mold ferrule 12, shank 40, and blade member 50. Molding techniques are being developed for LMM and the properties of the finished LMM part will make a superior ferrule 12 and shank 40 and blade 50. The LMM process starts with a family of amorphous metals and most typically an alloy or mixture of several metals. The liquid metal alloy has no crystalline structure typical of most metals. The superior strength to weight ratio of some amorphous metals makes them ideal materials for which to build a broadhead 10.

The yield strength of a specific liquid metal alloy V1T-001 is 250 KSI which is twice as strong as a titanium alloy. The density of V1T-001 is between titanium and steel. Since the density of V1T-001 is less than steel or a steel alloy such as 17-4PH, the ability to lengthen a broadhead exits which is desired while at the same time making the broadhead 10 stronger since 17-4PH has a yield strength of approximately 175 KSI. The hardness of V1T-001 is twice as hard as titanium or steel which is ideal for blade member 50 and ferrule 12. This disclosure covers all possible amorphous alloys molded using all casting techniques and injection molding techniques and contemplates utilizing any one or all of such processes to make either a ferrule 12, and/or a blade member 50, and/or a unitary broadhead. FIG. 14 illustrates the LMM manufacturing process that may be used to mold the ferrule 12 and/or the blade member 50.

It is contemplated that the ferrule 12 and shank 40 may be manufactured as separate components. The preferred method to manufacture the ferrule 12 is using the MIM process described above. The ferrule 12 will have a separate mating hole with which to mate with the shank 40. The separate shank 40 may be made using conventional machining practices or using the preferred MIM process. The separate ferrule 12 and shank 40 may be joined in a number of ways including sintering the parts together, press-fitting the parts together or threadedly coupling the parts together. Molding the ferrule 12 separately has benefits including a less complex mold design and the ability to place the groove bottom 26 of the blade grooves 24 closer to the longitudinal axis A which in turn will enable the outside diameter of the ferrule 12 to decrease which allows the ferrule 40 length to grow. However such a configuration mandates two separate parts.

Materials from which the ferrule 12 and/or shank 40 may be fabricated include any suitable metallic or polymeric material. Regarding metallic materials which may be used to fabricate the ferrule 12 and/or shank 40, titanium, stainless steel such as 17-4 precipitation hardened (PH) as sintered or 17-4PH solutionized and aged may be used although a wide variety of materials and fabrication methods may be used to form the ferrule 12 and/or shank 40. In this regard, the blade members 50 are preferably formed of the same or similar materials as that used to form the ferrule 12. In addition, the blade members 50 may be formed using LMM, metal casting, stamping, die cutting, and MIM.

Referring now to FIGS. 8–12, also disclosed is a field point 90 for an arrow 70. As was earlier mentioned, the field point 90 as shown and described herein is specifically configured to be compatible with the broadhead 10 configuration described above. Broadheads of the prior art have a range of masses and a corresponding range of balance points or center of gravity. Field points are therefore not readily available with physical properties that match broadheads. Therefore, the field point 90 as described herein is specifically configured to be complementary to the broadhead 10 in that the field point 90 has a mass, a length, and center of gravity that is substantially matched to the broadhead 10 disclosed herein.

Using the broadhead 10 in combination with the field point 90, an archer may tune an archery bow with which the broadhead 10 may be shot, for target practice on non-game targets, and to compete in archery target tournaments. The field point 90 as shown in FIGS. 8–12 is manufactured as a monolithic solid ferrule including a shank 40, intermediate portion 94, rear portion 96 and tip portion 92. The materials used to manufacture the field point 90 are metallic materials including but not limited to titanium, copper, steel, and stainless steel.

The field point 90 is a monolithic solid comprising an elongate ferrule 12 having a tip end 14 and a mating end 16 with a longitudinal axis A extending therebetween. In this regard, the field point 90 lacks the blade grooves 24 that may be part of the ferrule 12 described above. Therefore, the field point 90 does not include means for readily attaching the blade members 50 thereto. The field point 90 may be provided in varying lengths each having a different balance point or center of gravity along its longitudinal axis A. Each monolithic solid field point 90 may be described as comprising a tip portion 92, an intermediate portion 94 and a rear portion 96. The tip portion 92 is relatively short when compared to the intermediate portion 94.

The tip portion 92 is formed starting at a sharp point and extending towards the shank 40, with a sharply increasing the diameter of the tip portion 92 in a linear fashion along a longitudinal axis A. The intermediate portion 94 is formed starting at the tip and increasing the diameter in a linear fashion, with a shallow slope when compared to the slope of the tip portion 92, along a longitudinal axis A. The rear portion 96 is preferably cylindrical in shape.

The intermediate portion 94 is disposed between the tip portion 92 and the rear portion 96. Like the tip portion 92, the intermediate portion 94 may also have a tapered or conical shape. The rear portion 96 is disposed adjacent to the mating end 16. The rear portion 96 may be generally cylindrically shaped with an outer diameter of the rear portion 96 being substantially equivalent to an outer diameter of the shaft 72 of the arrow 70 upon which the field point 90 may be mounted. The intermediate portion 94 and rear portion 96*s* may be configured in a variety of alternative shapes and sizes.

As shown in FIGS. 8–12, the field point 90 may include a shank 40 extending axially from the mating end 16 of the field point 90. The shank 40 may have a threaded section 44 and a shoulder portion 46 disposed on opposite ends of the shank 40 in the same manner as was described above for the broadhead 10. The ring groove 48 may be formed in the shoulder portion 46 to receive the O-ring 80. The ring groove 48 ideally is sized to closely match the o-ring 80 however, the ring groove 48 maybe substantially wider than the o-ring 80 creating a situation where only the front half of the ring groove 48 is supporting the o-ring 80 upon installation of the point to the arrow, while when loosing the field point 90 only the rear portion of the ring groove supports the o-ring 80. The O-ring 80 prevents relative motion between the field point 90 and the shaft 72 of the arrow 70.

As was earlier mentioned, the inclusion of the O-ring 80 serves to center or align the field point 90 with the arrow 70 for greater accuracy in tuning the bow. In addition, because the field point 90 lacks the blade members 50 which the archer may otherwise grasp to tighten the field point 90 onto the arrow 70, the O-ring 80 prevents the field point 90 from vibrating loose over time. It is contemplated that the field point 90 may be provided in varying lengths with a corresponding range of masses of from about 50 grains to about 175 grains to match the mass and center of gravity of a set of broadheads 10 configured as described above. An exemplary mass for the field point 90 may be about 125 grains.

With reference to FIGS. 1–12, the operation of the broadhead 10 will now be discussed in conjunction with a discussion of the operation of the field point 90. The broadhead 10 may be assembled by first sliding one of the blade members 50 into a respective one of the blade grooves 24 along a direction from the mating end 16 forward toward the tip end 14. The T-shaped cross section of the blade groove 24 engages the T-shaped cross section of the blade member 50 to rigidly secure the blade member 50 to the ferrule 12. Once all the blade members 50 are inserted into the blade grooves 24, the collar 78 may be slid onto the shank 40 until butted up against the mating end 16 of the ferrule 12. The O-ring 80 is then mounted within the ring groove 48 of the shoulder portion 46. In this fully assembled condition, the broadhead 10 may be stored without the loss of components therefrom because the O-ring 80 prevents the blade members 50 from disengaging axially from the blade grooves 24.

The broadhead 10 may then be threadably engaged into the shaft bore 74 until the collar 78 is captured between the mating end 16 and the end of the shaft 72 of the arrow 70. In this manner, the blade members 50 are restricted from axially disengaging from the ferrule 12. In this fully assembled and installed configuration, the blades members 50 are fully locked to the broadhead 10 and cannot be pulled, jarred or separated from the ferrule 12 by any means encountered by shooting the broadhead 10 tipped arrow 70 from an archers bow. The T-lock blade member 50 attachment systems as defined herein is believed to be stronger than any known prior art replacement blade and/or blade attachment system. The O-ring 80 is preferably sized to provide an interference fit with the shaft counterbore 76 and the shoulder portion 46. The O-ring 80 also serves to generally align the broadhead 10 with the arrow 70 to ensure accurate flight of the arrow 70.

When harvesting game, the unique configuration of the blade members 50 allows the cutting edge 52 of the first portion 60 to easily pierce or penetrate the hide of the animal as well as interior areas of the animal such as tendons, muscle and other tissue. Such penetration is facilitated by the shallowness of the first angle $\theta_1$. The relatively large inner radius 54 connecting the first portion 60 to the second portion 62 serves to generate a relatively large entrance and exit wound in the animal to facilitate blood loss. In addition, the cutting edge 52 is configured to generate deep cutting channels through the animal's tissue to further facilitate a swift and humane harvest. In addition, the relatively large inner radius 54 adds considerable strength to the blade member 50 and minimizes the stress generated by the steep second angle $\theta_2$.

In order to tune the bow from which the broadhead 10 may be shot, the field point 90 of the same weight classification is selected and threadably engaged into the arrow 70 in the same manner as that described above for attachment of the broadhead 10. For example, if the broadhead 10 has a mass of 125 grains and a given length and center of gravity, then the field point 90 of substantially the same mass, length, and center of gravity will be selected to tune the bow. The tuning is performed using any one of a variety of techniques.

For example, the archer may shoot an arrow 70 having the field point 90 mounted thereon with adjustments being made to the various components of the bow such as the arrow rest and the nocking point indicator. Other adjustments may be made until several arrows 70 that are aimed and shot at the target actually hit the target at substantially the same location. The archer may then use a corresponding one of the broadheads 10 of the same weight classification for hunting game with an expectation that the broadhead 10 will follow a similar flight pattern as that of the field point 90. The minimal offset of the geometric center of the first portion 60 minimizes wind vaning during flight of the broadhead 10 while simultaneously facilitating effective penetration of the hide of the animal.

The broadhead 10 may be disassembled by reversing the assembly procedure described above. Once the blade members 50 are removed, the cutting edges 52 may be sharpened using any suitable blade sharpening instrument. Nicks in the cutting edge 52 can be removed at this time. Damaged blade members 50 may be replaced by inserting the base portion 64 into the blade groove 24, mounting the collar 78 on the shoulder portion 46 and placing the O-ring 80 in the ring groove 48. The broadhead 10 may then be threaded into the shaft bore 74.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A broadhead for an arrow, comprising:

an elongate ferrule having a mating end and a tip end with a longitudinal axis extending therebetween, the ferrule having an outer surface with a tri-ovally shaped cross section and having at least one axially aligned elongate blade groove of T-shaped cross section extending radially inwardly from the outer surface; and at least one blade member having a base portion that is shaped complementary to the blade groove and configured to be axially insertable thereinto.

2. The broadhead of claim 1 wherein:

the outer surface has a plurality of convex ridges equiangularly spaced therearound, each one of the ridges being separated by a trough such that the ferrule has a tri-ovally shaped cross section, each one of the ridges having one of the blade grooves formed therein for receiving a blade member.

3. The broadhead of claim 2 wherein:

the outer surface has three convex ridges formed thereon and being equiangularly spaced therearound, each one of the ridges being separated by a trough to define the tri-ovally shaped cross section;

the tip end including three equiangularly spaced tip flats equal in number to the quantity of blade members, each one of the tip flats being angularly aligned with and extending from a respective one of the troughs at a location adjacent an end of the blade grooves nearest the tip end, the tip flats converging to a point.

4. The broadhead of claim 1 wherein the blade groove has a cross-sectional area that is generally tapered along a direction from the mating end to the tip end such that the cross-sectional area is largest at the mating end.

5. The broadhead of claim 1 further comprising:

an O-ring;

wherein the broadhead includes a shank extending axially outwardly from the mating end, the arrow including a shaft having a shaft bore, the O-ring being circumferentially mountable on the shank.

6. The broadhead of claim 5 wherein the O-ring is sized and configured to restrict movement of the blade member within the blade groove along a direction from the tip end toward the mating end.

7. The broadhead of claim 5 wherein the O-ring is captured between the shank and the shaft bore and is configured to restrict relative radial movement therebetween when the broadhead is secured to the arrow at the mating end.

8. The broadhead of claim 5 wherein:

the shank has an enlarged diameter shoulder portion formed thereon proximate the mating end and a threaded section formed on an end opposite the shoulder portion;

the shoulder portion having a circumferential ring groove formed therearound for receiving the O-ring.

9. The broadhead of claim 8 wherein the shank includes at least one shank guide formed thereon in axial alignment with the blade groove, the shank guide being configured to provide clearance for the blade member during insertion into and removal from the blade groove.

10. The broadhead of claim 9 wherein:

the threaded section defining a minor thread diameter;

the shank guide being formed at depth equal to or less than the minor thread diameter, the shank guide extending axially through the threaded section and shoulder portion; the blade groove having a groove bottom formed thereon in general radial alignment with the shank guide.

11. The broadhead of claim 1 wherein:

the blade member extends radially outwardly from the ferrule and has first and second portions respectively located adjacent the tip and mating ends, each of the first and second portions having cutting edges;

the cutting edge of the first portion being inclined at a first angle relative to the longitudinal axis;

the cutting edge of the second portion being inclined at a second angle relative to the longitudinal axis, the second angle being substantially greater than the first angle;

the cutting edge of the first and second portions being joined by an inner radius in the range of from about 0.15 inches to about 0.75 inches.

12. The broadhead of claim 11 wherein:

the first angle is less than about 15 degrees relative to the longitudinal axis;

the second angle is in the range of from about 50 degrees to about 80 degrees relative to the longitudinal axis.

13. The broadhead of claim 11 wherein:

each one of the first and second portions defines a surface area having a geometric center that is offset from the longitudinal axis, the blade member being configured such that the geometric center offset of the second portion is substantially greater than the geometric center offset of the first portion.

14. The broadhead of claim 1 wherein at least one of the ferrule and the blade member is formed as a unitary structure by metal injection molding.

15. The broadhead of claim 1 wherein the broadhead is formed as a unitary structure by metal injection molding.

16. The broadhead of claim 1 wherein at least one of the ferrule and the blade member is formed by liquid metal molding.

17. The broadhead of claim 1 wherein the broadhead is formed as a unitary structure by liquid metal molding.

18. A broadhead for an arrow, comprising:

an elongate ferrule having a mating end and a tip end with a longitudinal axis extending therebetween, the ferrule having at least one axially aligned elongate blade groove extending radially inwardly from the outer surface; and at least one blade member having a base portion that is shaped complementary to the blade groove, the blade member being axially aligned with the ferrule and extending radially outwardly therefrom;

wherein the broadhead includes a shank extending axially outwardly from the mating end, the shank including at least one shank guide formed thereon in axial alignment with the blade groove, the shank having a threaded section formed on an end thereof opposite the mating end and defining a minor thread diameter, the shank guide being formed at a depth equal to or less than the minor thread diameter and extending axially through the threaded section, the shank guide being configured to provide clearance for the blade member during insertion into and removal from the blade groove.

19. A broadhead for an arrow, comprising:

an elongate ferrule having a mating end and a tip end with a longitudinal axis extending therebetween; and at least one blade member axially aligned with the ferrule and extending radially outwardly therefrom, the blade member having first and second portions respectively located adjacent the tip and mating ends, each of the first and second portions having cutting edges;

wherein:

the cutting edge of the first portion is inclined at a first angle relative to the longitudinal axis;

the cutting edge of the second portion being inclined at a second angle relative to the longitudinal axis, the second angle being substantially greater than the first angle;

the cutting edge of the first and second portions being joined by an inner radius in the range of from about 0.15 inches to about 0.75 inches.

20. The broadhead of claim 19 wherein:

the first angle is less than about 15 degrees relative to the longitudinal axis;

the second angle is in the range of from about 50 degrees to about 80 degrees relative to the longitudinal axis.

21. The broadhead of claim 19 wherein:

each one of the first and second portions defines a surface area having a geometric center that is offset from the longitudinal axis, the blade member being configured such that the geometric center offset of the second portion is substantially greater than that of the first portion.

22. The broadhead of claim 19 further comprising:

an O-ring;

wherein the broadhead includes a shank extending axially outwardly from the mating end, the arrow including a shaft having a shaft bore, the O-ring being circumferentially mountable on the shank.

23. The broadhead of claim 22 wherein:

the shank has an enlarged diameter shoulder portion formed thereon proximate the mating end and a threaded section formed on an end opposite the shoulder portion;

the shoulder portion having a circumferential ring groove formed therearound for receiving the O-ring;

the O-ring being sized and configured to generate an interference fit between the shoulder portion and the shaft bore when the threaded section is threadably engagable thereinto.

24. A broadhead for an arrow having a shaft bore, the broadhead comprising:

an elongate ferrule having a mating end and a tip end with a longitudinal axis extending therebetween, the ferrule having a shank extending axially outwardly from the mating end;

at least one blade member axially aligned with the ferrule and extending radially outwardly therefrom; and an O-ring;

wherein the O-ring is circumferentially mountable on the shank and configured to be captured between the shank and the shaft bore to restrict relative movement therebetween when the broadhead is secured to the arrow at the mating end.

25. The broadhead of claim 24 wherein:

the shank has an enlarged diameter shoulder portion formed thereon proximate the mating end and a threaded section formed on an end opposite the shoulder portion;

the shoulder portion having a circumferential ring groove formed therearound for receiving the O-ring.

26. A broadhead for an arrow including a shaft having a shaft bore, the broadhead comprising:

an elongate ferrule having a mating end and a tip end with a longitudinal axis extending therebetween, the ferrule having a shank extending axially outwardly from the mating end, the shank having an enlarged diameter shoulder portion formed thereon proximate the mating end and a threaded section formed on an end opposite the shoulder portion, the shoulder portion having a circumferential ring groove formed therearound, the ferrule having an outer surface with three convex ridges formed thereon and equiangularly spaced therearound, each one of the ridges being separated by a trough such that the ferrule generally has a tri-ovally shaped cross section, the cross section of the ferrule being generally constant between the mating and tip ends, each one of the ridges having an axially aligned elongate blade groove formed therein and extending radially inwardly from the outer surface, each blade groove having an outer groove portion and an inner groove portion disposed radially inwardly from the outer groove portion, a width of the inner groove portion being larger than that of the outer groove portion such that that each one of the blade grooves defines a T-shaped cross section, the width of the T-shaped cross section gradually increasing in size along a direction from the tip end to the mating end, the tip end including three equiangularly spaced tip flats extending from each one of the troughs and converging to a point, the shank including at least one shank guide formed thereon in axial alignment with the blade groove, the threaded section defining a minor thread diameter, the shank guide being formed at depth equal to or less than the minor thread diameter, the shank guide extending axially through the threaded section and shoulder portion, the shank guide being configured to provide clearance for the blade member during insertion into and removal from the blade groove;

a plurality of generally planar removable blade members equal in number to the quantity of blade grooves, each one of the blade members having a cutting edge, a trailing edge and a base portion, the base portion being shaped complementary to that of the blade groove such that each one of the blade members is axially insertable into a corresponding one of the blade grooves in an axial direction from the mating end toward the tip end, each one of the blade members extending radially outwardly from the ferrule and having first and second portions respectively located adjacent the tip and mating ends, the cutting edge of the first and second portions being respectively inclined at first and second angles relative to the longitudinal axis, the second angle being in the range of from about four to eight times as great as the first angle, each one of the first and second portions defining a surface area having a geometric center that is offset from the longitudinal axis, the blade member being configured such that the geometric center offset of the second portion is substantially greater than that of the first portion;

a resilient O-ring circumferentially mountable within the ring groove, the O-ring being sized to create an interference fit between the shoulder portion and the shaft bore when the threaded section is threadably engagable thereinto; and an annular collar mountable on the shank and captured between the O-ring and the mating end, the collar being configured to restrict axial movement of the blade members when the base portions are inserted into a respective one of the blade grooves when the broadhead is secured to the arrow;

wherein the ferrule and the shank are formed as a unitary structure by metal injection molding using a powdered composition that is sintered at an elevated temperature.

27. The broadhead of claim 26 wherein the outer surface has three convex ridges formed thereon and being generally equiangularly spaced therearound.

* * * * *